US008366565B2

(12) United States Patent
Tavares et al.

(10) Patent No.: US 8,366,565 B2
(45) Date of Patent: Feb. 5, 2013

(54) GOLF CLUB ASSEMBLY AND GOLF CLUB WITH AERODYNAMIC FEATURES

(75) Inventors: Gary G. Tavares, Azle, TX (US); Robert Boyd, Euless, TX (US); John Thomas Stites, Weatherford, TX (US)

(73) Assignee: NIKE, Inc., Beaverton, OR (US)

( * ) Notice: Subject to any disclaimer, the term of this patent is extended or adjusted under 35 U.S.C. 154(b) by 445 days.

(21) Appl. No.: 12/779,669

(22) Filed: May 13, 2010

(65) Prior Publication Data

US 2010/0311517 A1 Dec. 9, 2010

Related U.S. Application Data

(63) Continuation-in-part of application No. 12/465,164, filed on May 13, 2009, now Pat. No. 8,162,775.

(60) Provisional application No. 61/298,742, filed on Jan. 27, 2010.

(51) Int. Cl.
*A63B 53/04* (2006.01)

(52) U.S. Cl. ..... 473/324; 473/327; 473/328

(58) Field of Classification Search ..... 473/324–350, 473/287–292, 228; D21/752, 759
See application file for complete search history.

(56) References Cited

U.S. PATENT DOCUMENTS

| | | | |
|---|---|---|---|
| 1,587,758 | A | 6/1926 | Charavay |
| 4,444,392 | A | 4/1984 | Duclos |
| D275,412 | S | 9/1984 | Simmons |
| 4,653,756 | A | 3/1987 | Sato |
| 4,850,593 | A | 7/1989 | Nelson |
| D307,783 | S | 5/1990 | Iinuma |
| D310,254 | S | 8/1990 | Take et al. |
| 5,054,784 | A | 10/1991 | Collins |
| 5,120,061 | A | 6/1992 | Tsuchida et al. |
| 5,158,296 | A | 10/1992 | Lee |
| 5,190,289 | A | 3/1993 | Nagai et al. |
| 5,193,810 | A | 3/1993 | Antonious |
| 5,203,565 | A | 4/1993 | Murray et al. |
| 5,221,086 | A | 6/1993 | Antonious |
| 5,240,252 | A | 8/1993 | Schmidt et al. |
| D340,493 | S | 10/1993 | Murray et al. |

(Continued)

FOREIGN PATENT DOCUMENTS

| | | | |
|---|---|---|---|
| JP | 2009000281 | A | 1/2009 |
| WO | 2010028114 | A2 | 3/2010 |

(Continued)

OTHER PUBLICATIONS

Office Action issued Sep. 23, 2010 in parent U.S. Appl. No. 12/465,164.

(Continued)

*Primary Examiner* — Sebastiano Passaniti
(74) *Attorney, Agent, or Firm* — Banner & Witcoff, Ltd.

(57) ABSTRACT

A golf club head includes a body member having a ball striking face, a crown, a toe, a heel, a sole, a back and a hosel region, located at the intersection of the ball striking face, the heel, the crown and the sole. The body member may have a first cross-section having a first airfoil-shaped surface in the heel. The first cross-section may be oriented at approximately 90° from the centerline of the club head. The body member may have a second cross-section having a second airfoil-shaped surface. The second cross-section may be oriented at approximately 45° or at approximately 70°. The airfoil-shaped surfaces may be defined by spline points or by equations. A golf club including the golf club head is also provided.

34 Claims, 21 Drawing Sheets

U.S. PATENT DOCUMENTS

| | | | |
|---|---|---|---|
| 5,271,622 | A | 12/1993 | Rogerson |
| 5,318,297 | A | 6/1994 | Davis et al. |
| D350,176 | S | 8/1994 | Antonious |
| D351,441 | S | 10/1994 | Iinuma et al. |
| 5,435,558 | A | 7/1995 | Iriarte |
| 5,465,970 | A | 11/1995 | Adams et al. |
| 5,505,448 | A | 4/1996 | Park |
| 5,511,786 | A | 4/1996 | Antonious |
| 5,524,890 | A | 6/1996 | Kim et al. |
| 5,544,884 | A | 8/1996 | Hardman |
| 5,575,725 | A | 11/1996 | Olsavsky |
| D379,390 | S | 5/1997 | Watanabe et al. |
| 5,643,107 | A | 7/1997 | Gorman |
| 5,681,227 | A | 10/1997 | Sayrizi |
| D389,886 | S | 1/1998 | Kulchar et al. |
| 5,735,754 | A | 4/1998 | Antonious |
| 5,785,609 | A | 7/1998 | Sheets et al. |
| D398,681 | S | 9/1998 | Galy |
| 5,803,830 | A | 9/1998 | Austin et al. |
| 5,873,793 | A | 2/1999 | Swinford |
| 5,913,733 | A | 6/1999 | Bamber |
| 5,921,870 | A | 7/1999 | Chiasson |
| 5,954,595 | A | 9/1999 | Antonious |
| 5,961,397 | A | 10/1999 | Lu et al. |
| 5,980,394 | A | 11/1999 | Domas |
| 5,997,413 | A | 12/1999 | Wood, IV |
| 5,997,415 | A | 12/1999 | Wood |
| 6,017,280 | A | 1/2000 | Hubert |
| 6,027,414 | A | 2/2000 | Koebler |
| D421,472 | S | 3/2000 | Peterson |
| D422,659 | S | 4/2000 | Mertens |
| 6,059,669 | A | 5/2000 | Pearce |
| 6,074,308 | A | 6/2000 | Domas |
| 6,319,148 | B1 | 11/2001 | Tom |
| D470,202 | S | 2/2003 | Tunno |
| 6,530,847 | B1 | 3/2003 | Antonious |
| 6,561,922 | B2 | 5/2003 | Bamber |
| 6,609,981 | B2 | 8/2003 | Hirata |
| D481,430 | S | 10/2003 | Tunno |
| 6,773,359 | B1 | 8/2004 | Lee |
| D498,508 | S | 11/2004 | Antonious |
| 6,824,474 | B1 | 11/2004 | Thill |
| 6,855,068 | B2 | 2/2005 | Antonious |
| 6,890,267 | B2 | 5/2005 | Mahaffey |
| D509,869 | S | 9/2005 | Mahaffey |
| 7,390,266 | B2 | 6/2008 | Gwon |
| 7,568,985 | B2 | 8/2009 | Beach et al. |
| D608,850 | S | 1/2010 | Oldknow |
| D609,296 | S | 2/2010 | Oldknow |
| D609,297 | S | 2/2010 | Oldknow |
| D609,764 | S | 2/2010 | Oldknow |
| 7,713,138 | B2 | 5/2010 | Sato et al. |
| 8,162,775 | B2 | 4/2012 | Tavares et al. |
| 2001/0027139 | A1 | 10/2001 | Saso |
| 2002/0077194 | A1 | 6/2002 | Carr et al. |
| 2002/0077195 | A1 | 6/2002 | Carr et al. |
| 2003/0087710 | A1 | 5/2003 | Sheets et al. |
| 2003/0220154 | A1 | 11/2003 | Anelli |
| 2003/0232659 | A1 | 12/2003 | Mahaffey et al. |
| 2003/0236131 | A1 | 12/2003 | Burrows |
| 2004/0018891 | A1 | 1/2004 | Antonious |
| 2004/0138002 | A1 | 7/2004 | Murray |
| 2004/0229713 | A1 | 11/2004 | Helmstetter et al. |
| 2005/0009622 | A1 | 1/2005 | Antonious |
| 2005/0032584 | A1 | 2/2005 | Van Nimwegen |
| 2005/0049073 | A1 | 3/2005 | Herber |
| 2005/0153798 | A1 | 7/2005 | Rigoli |
| 2005/0153799 | A1 | 7/2005 | Rigoli |
| 2006/0014588 | A1 | 1/2006 | Page |
| 2007/0149310 | A1 | 6/2007 | Bennett et al. |
| 2008/0188320 | A1 | 8/2008 | Kamatari |
| 2009/0124410 | A1 | 5/2009 | Rife |
| 2009/0149276 | A1 | 6/2009 | Golden et al. |
| 2009/0203465 | A1 | 8/2009 | Stites et al. |
| 2009/0286618 | A1 | 11/2009 | Beach et al. |
| 2010/0292020 | A1* | 11/2010 | Tavares et al. ..... 473/282 |
| 2010/0311517 | A1 | 12/2010 | Tavares et al. |
| 2011/0136584 | A1* | 6/2011 | Boyd et al. ..... 473/327 |
| 2011/0281663 | A1* | 11/2011 | Stites et al. ..... 473/327 |
| 2011/0281664 | A1* | 11/2011 | Boyd et al. ..... 473/327 |
| 2012/0178548 | A1* | 7/2012 | Tavares et al. ..... 473/324 |

FOREIGN PATENT DOCUMENTS

| | | | |
|---|---|---|---|
| WO | 2010104898 | A2 | 9/2010 |

OTHER PUBLICATIONS

Office Action issued Mar. 11, 2011 in parent U.S. Appl. No. 12/465,164.

International Search Report and Written Opinion mailed Apr. 27, 2011 in related PCT Application No. PCT/US2011/022311.

International Search Report and Written Opinion mailed Apr. 28, 2011 in related PCT Application No. PCT/US2011/022352.

International Search Report and Written Opinion mailed Apr. 27, 2011 in related PCT Application No. PCT/US2011/022356.

Adamsgolf, Speedline Driver advertisement, Golf World magazine, Mar. 9, 2009, p. 15.

Non-Final Office Action dated Jul. 9, 2012, issued in U.S. Appl. No. 13/427,211.

Final Office Action issued Aug. 30, 2011 in related U.S. Appl. No. 12/465,164.

International Search Report and Written Opinion issued Aug. 5, 2010 in related PCT Application No. PCT/US2010/034768.

International Search Report and Written Opinion issued Aug. 5, 2010 in related PCT Application No. PCT/US2010/034031.

Achenbach, James, Pros Test New Nike Drivers, Golfweek, Oct. 3, 2009, http://www.golfweek.com/news/2009/oct/12/pros-test-new-nike-drivers/.

* cited by examiner

GOLF CLUB ASSEMBLY AND GOLF CLUB WITH AERODYNAMIC FEATURES

RELATED APPLICATIONS

The present patent application is a continuation-in-part of U.S. patent application Ser. No. 12/465,164, filed May 13, 2009, entitled "Golf Club Assembly and Golf Club With Aerodynamic Features," and naming Gary Tavares, et al. as inventors. Further, this application claims the benefit of priority of Provisional Application No. 61/298,742, filed Jan. 27, 2010, entitled "Golf Club Assembly and Golf Club With Aerodynamic Features," and naming Gary Tavares, et al. as inventors. Each of these earlier filed applications is incorporated herein by reference in its entirety.

FIELD

Aspects of this invention relate generally to golf clubs and golf club heads, and, in particular, to golf clubs and golf club heads with improved aerodynamic features.

BACKGROUND

The distance a golf ball travels when struck by a golf club is determined in large part by club head speed at the point of impact with the golf ball. Club head speed in turn can be affected by the wind resistance or drag provided by the club head during the entirety of the swing, especially given the large club head size of a driver. The club head of a driver or a fairway wood in particular produces significant aerodynamic drag during its swing path. The drag produced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surface of the club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the greater the pressure drag.

One way to reduce or minimize the size of the low pressure separation region is by providing a streamlined form that allows laminar flow to be maintained for as long as possible, thereby delaying or eliminating the separation of the laminar air stream from the club surface.

Reducing the drag of the club head not only at the point of impact, but also during the course of the entire downswing prior to the point of impact, would result in improved club head speed and increased distance of travel of the golf ball. When analyzing the swing of golfers, it has been noted that the heel/hosel region of the club head leads the swing during a significant portion of the downswing and that the ball striking face only leads the swing at (or immediately before) the point of impact with the golf ball. The phrase "leading the swing" is meant to describe that portion of the club head that faces the direction of swing trajectory. For purposes of discussion, the golf club and golf club head are considered to be at a 0° orientation when the ball striking face is leading the swing, i.e. at the point of impact. It has been noted that during a downswing, the golf club may be rotated by about 90° or more around the longitudinal axis of its shaft during the 90° of downswing prior to the point of impact with the golf ball.

During this final 90° portion of the downswing, the club head may be accelerated to approximately 65 miles per hour (mph) to over 100 mph, and in the case of some professional golfers, to as high as 140 mph. Further, as the speed of the club head increases, typically so does the drag acting on the club head. Thus, during this final 90° portion of the downswing, as the club head travels at speeds upwards of 100 mph, the drag force acting on the club head could significantly retard any further acceleration of the club head.

Club heads that have been designed to reduce the drag of the head at the point of impact, or from the point of view of the club face leading the swing, may not function well to reduce the drag during other phases of the swing cycle, such as when the heel/hosel region of the club head is leading the downswing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

This application discloses a golf club head with improved aerodynamic performance. In accordance with certain aspects, a golf club head may include a body member having a ball striking face, a crown, a toe, a heel, a sole, a rear, and a hosel region located at the intersection of the ball striking face, the heel, the crown and the sole. A drag reducing structure on the body member may be configured to reduce drag for the club head during at least a portion of a golf downswing from an end of a backswing through a point-of-impact with the golf ball, and optionally, through at least the last 90° of the downswing up to and immediately prior to impact with the golf ball.

In accordance with certain aspects, a golf club head for a driver, having a volume of 400 cc or greater and a club breadth-to-face length ratio of 0.90 or greater, includes a body member having a crown, a sole, and a heel. A leading edge may be included on the heel, the leading edge defined as the surface of the heel having a vertical slope when the club head is in a 60 degree lie angle position. The body member may further have a first cross-section, wherein the first cross-section includes an apex point located on the leading edge, a first crown-side surface extending from the apex point, and a first sole-side surface extending from the apex point. The first cross-section may be oriented perpendicular to a centerline of the club head. The apex point may represent an origin of a first $x_1$- and $z_1$-coordinate system oriented in the plane of the first cross-section at a roll angle of approximately 15°. The first crown-side surface may be defined by the following spline points:

| | $x_1$-coordinate (mm) | | | | | |
|---|---|---|---|---|---|---|
| | 0 | 6 | 12 | 24 | 36 | 48 |
| $z_{1U}$-coordinate (mm) | 0 | 11 | 16 | 22 | 25 | 26 |

According to certain aspects, the first sole-side surface may be defined by the following spline points:

| | $x_1$-coordinate (mm) | | | | | |
|---|---|---|---|---|---|---|
| | 0 | 6 | 12 | 24 | 36 | 48 |
| $z_{1L}$-coordinate (mm) | 0 | −14 | −19 | −25 | −29 | −32 |

According to other aspects, the body member further may have a second cross-section, wherein the second cross-section includes the apex point located on the leading edge, a second crown-side surface extending from the apex point, and a second sole-side surface extending from the apex point. The second cross-section may be oriented at approximately 70° from the centerline of the club head. The apex point further may represent an origin of a second $x_2$- and $z_2$-coordinate system oriented in the plane of the second cross-section at a roll angle of approximately 15°. The second crown-side surface may be defined by the following spline points:

| | $x_2$-coordinate (mm) | | | | | |
|---|---|---|---|---|---|---|
| | 0 | 6 | 12 | 24 | 36 | 48 |
| $z_{2U}$-coordinate (mm) | 0 | 11 | 16 | 21 | 24 | 25 |

The second sole-side surface may be defined by the following spline points:

| | $x_2$-coordinate (mm) | | | | | |
|---|---|---|---|---|---|---|
| | 0 | 6 | 12 | 24 | 36 | 48 |
| $z_{2L}$-coordinate (mm) | 0 | −13 | −18 | −24 | −28 | −30 |

According to even other aspects, the body member may be configured for attachment to a shaft having a longitudinal axis, and the apex point may be located approximately 15 mm to approximately 25 mm from the longitudinal axis of the shaft. Alternatively, the apex point may be located approximately 20 mm from the longitudinal axis of the shaft.

According to certain aspects, the club head may have a volume greater than or equal to 420 cc. The club head may have a face height greater than or equal to 53 mm. Further, the club breadth-to-face length ratio of 0.92 or greater.

According to certain aspects, the body member may further include a groove extending at least partially along a length of the toe and extending at least partially along a length of the back. The groove may be a Kammback feature.

According to even other aspects, the body member may even further include a diffuser located on the sole and oriented at an angle from the centerline of the club head of from approximately 10° to approximately 80°. Alternatively, the diffuser may be oriented at an angle from the centerline of the club head of from approximately 50° to approximately 70°.

According to certain aspects, a golf club head may include a first cross-section oriented perpendicular to a centerline of the club head, and $x_1$- and $z_1$-coordinates of a first crown-side surface curve of the first cross-section may be defined by the following Bézier equations:

$$x_{1U}=3\,(17)\,(1-t)\,t^2+(48)\,t^3$$

$$z_{1U}=3\,(10)\,(1-t)^2\,t+3\,(26)\,(1-t)\,t^2+(26)\,t^3$$

over the range of: $0 \leqq t \leqq 1$.

According to other aspects, $x_1$- and $z_r$coordinates of a first sole-side surface curve of the first cross-section may be defined by the following Bézier equations:

$$x_{1L}=3\,(11)\,(1-t)\,t^2+(48)\,t^3$$

$$z_{1L}=3\,(-10)\,(1-t)^2\,t+3\,(-26)\,(1-t)\,t^2+(-32)\,t^3$$

over the range of: $0 \leqq t \leqq 1$.

The golf club head may further include a second cross-section, wherein the second cross-section is oriented at approximately 70° from the centerline of the club head. The $x_{2U}$- and $z_{2U}$-coordinates of a second crown-side surface curve of the second cross-section may be defined by the following Bézier equations:

$$x_{2U}=3\,(19)\,(1-t)\,\mathrm{i}\,t^2+(48)\,t^3$$

$$z_{2U}=3\,(10)\,(1-t)^2\,t+3\,(25)\,(1-t)\,t^2+(25)\,t^3$$

over the range of: $0 \leqq t \leqq 1$.

Further, the $x_{1L}$- and $z_{1L}$-coordinates of a second sole-side surface curve of the second cross-section may be defined by the following Bézier equations:

$$x_{2L}=3\,(13)\,(1-t)\,t^2+(48)\,t^3$$

$$z_{2L}=3\,(-10)\,(1-t)^2\,t+3\,(-26)\,(1-t)\,t^2+(-30)\,t^3$$

over the range of: $0 \leqq t \leqq 1$.

According to even other aspects, the body member may have a first cross-section oriented at approximately 90° from a centerline of the club head and a second cross-section oriented at approximately 45° from the centerline of the club head. The first and second cross-sections may each include the apex point located on the heel and may each have a respective crown-side surface extending from the apex point and a respective sole-side surface extending from the apex point. The first cross-section may have a first airfoil-shaped surface in the heel and a first concave-shaped surface opposed to the first airfoil-shape surface. The second cross-section may have a second airfoil-shaped surface in the heel and a second concave-shaped surface opposed to the second airfoil-shape surface.

The first and the second concave-shaped surfaces may be formed by a continuous groove extending at least partially along the length of the toe and at least partially along the length of the back.

According to certain aspects, golf clubs including the disclosed golf club heads are also provided.

These and additional features and advantages disclosed here will be further understood from the following detailed disclosure of certain embodiments.

Figure 1A:
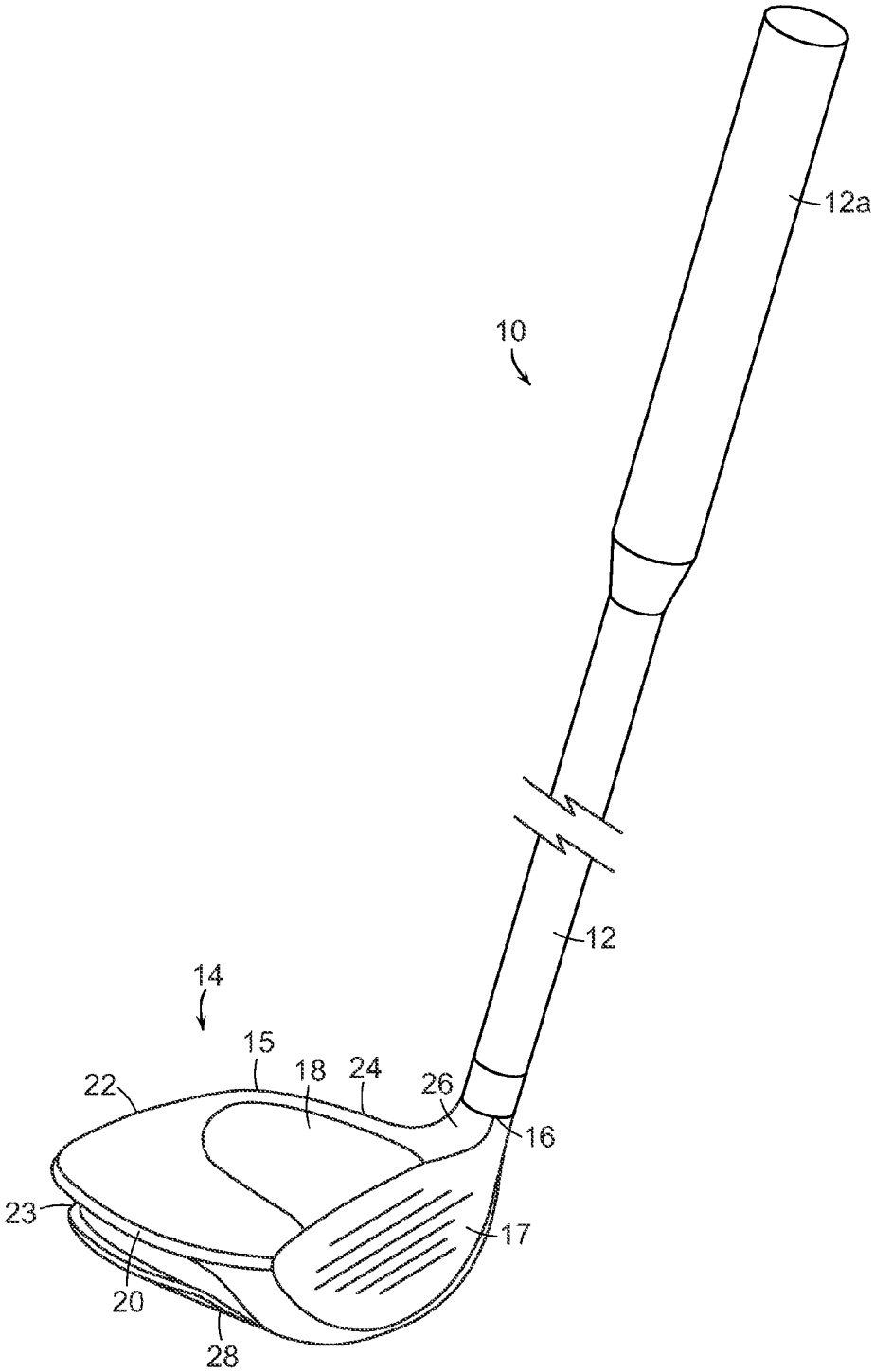
FIG. 1A is a perspective view of a golf club with a groove formed in its club head according to an illustrative aspect.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

An illustrative embodiment of a golf club 10 is shown in FIG. 1A and includes a shaft 12 and a golf club head 14 attached to the shaft 12. Golf club head 14 may be a driver, as shown in FIG. 1A. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors (including releasable and adjustable mechanisms), via friction fits, via retaining element structures, etc.). A grip or other handle element 12*a* may be positioned on the shaft 12 to provide a golfer with a slip resistant surface with which to grasp golf club shaft 12. The grip element 12*a* may be attached to the shaft 12 in any desired manner, including in conventional manners known and used in the art (e.g., via adhesives or cements, via threads or other mechanical connectors (including releasable connectors), via fusing techniques, via friction fits, via retaining element structures, etc.).

In the example structure of FIG. 1A, the club head 14 includes a body member 15 to which the shaft 12 is attached at a hosel or socket 16 for receiving the shaft 12 in known fashion. The body member 15 includes a plurality of portions, regions, or surfaces as defined herein. This example body member 15 includes a ball striking face 17, a crown 18, a toe 20, a back 22, a heel 24, a hosel region 26 and a sole 28. Back 22 is positioned opposite ball striking face 17, and extends between crown 18 and sole 28, and further extends between toe 20 and heel 24. This particular example body member 15 further includes a skirt or Kammback feature 23 and a recess or diffuser 36 formed in sole 28.

Figure 1B:
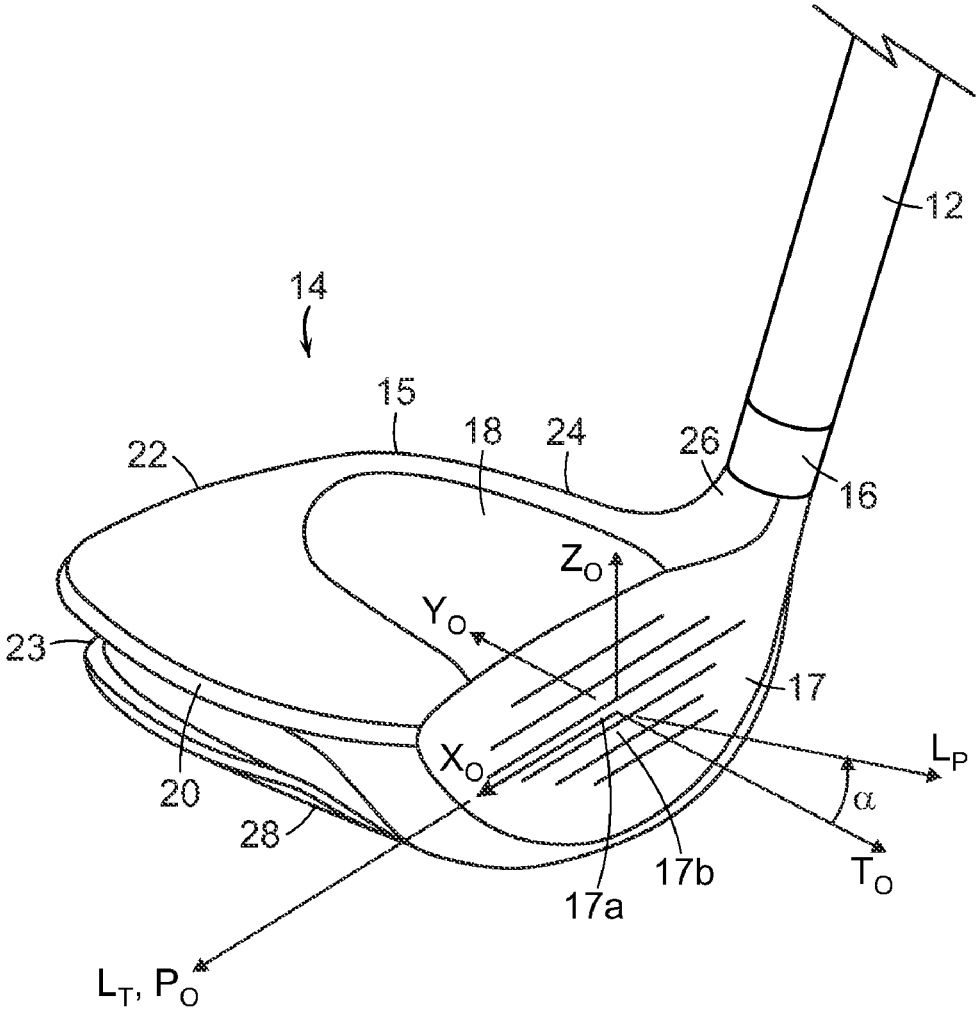
FIG. 1B is a close up of the club head of FIG. 1A with orientation axes provided.

Referring to FIG. 1B, the ball striking face region 17 is a region or surface that may be essentially flat or that may have a slight curvature or bow (also known as "bulge"). Although the golf ball may contact the ball striking face 17 at any spot on the face, the desired-point-of-contact 17*a* of the ball striking face 17 with the golf ball is typically approximately centered within the ball striking face 17. For purposes of this disclosure, a line $L_T$ drawn tangent to the surface of the striking face 17 at the desired-point-of-contact 17*a* defines a direction parallel to the ball striking face 17. The family of lines drawn tangent to the surface of the striking face 17 at the desired-point-of-contact 17*a* defines a striking face plane 17*b*. Line $L_P$ defines a direction perpendicular to the striking face plane 17*b*. Further, the ball striking face 17 may generally be provided with a loft angle $\alpha$, such that at the point of impact (and also at the address position, i.e., when the club head is positioned on the ground adjacent to the golf ball prior to the initiation of the backswing) the ball striking plane 17*b* is not perpendicular to the ground. Generally, the loft angle $\alpha$ is meant to affect the initial upward trajectory of the golf ball at the point of impact. Rotating the line $L_P$ drawn perpendicular to the striking face plane 17*b* through the negative of the loft angle $\alpha$ defines a line $T_0$ oriented along the desired club-head-trajectory at the point of impact. Generally, this point-of-impact club-head-trajectory direction $T_0$ is perpendicular to the longitudinal axis of the club shaft 12.

Still referring to FIG. 1B, a set of reference axes ($X_0$, $Y_0$, $Z_0$) associated with a club head oriented at a 60 degree lie angle position with a face angle of zero degrees (see, e.g., USGA Rules of Golf, Appendix II and see also, FIG. 28) can now be applied to the club head 14. The $Y_0$-axis extends from the desired-point-of-contact 17*a* along the point-of-impact club-head-trajectory line in a direction opposite to the $T_0$ direction. The $X_0$-axis extends from desired-point-of-contact 17*a* generally toward the toe 20 and is perpendicular to the $Y_0$-axis and parallel to the horizontal with the club at a 60 degree lie angle position. Thus, the line $L_T$, when drawn parallel to the ground, is coincident with the $X_0$-axis. The $Z_0$-axis extends from desired-point-of-contact 17*a* generally vertically upward and perpendicular to both the $X_0$-axis and the $Y_0$-axis. For purposes of this disclosure, the "centerline" of the club head 14 is considered to coincide with the $Y_0$-axis (and also with the $T_0$ line). The term "rearwardly" as used herein generally refers to a direction opposite to the point-of-impact club-head trajectory direction $T_0$, i.e., in the positive direction of the $Y_0$-axis.

Referring now to FIGS. 1-6, the crown 18, which is located on the upper side of the club head 14, extends from the ball striking face 17 back toward the back 22 of the golf club head 14. When the club head 14 is viewed from below, i.e., along the $Z_0$-axis in the positive direction, the crown 18 cannot be seen.

The sole 28, which is located on the lower or ground side of the club head 14 opposite to the crown 18, extends from the ball striking face 17 back to the back 22. As with the crown 18, the sole 28 extends across the width of the club head 14, from the heel 24 to the toe 20. When the club head 14 is viewed from above, i.e., along the $Z_0$-axis in the negative direction, the sole 28 cannot be seen.

Figure 3:
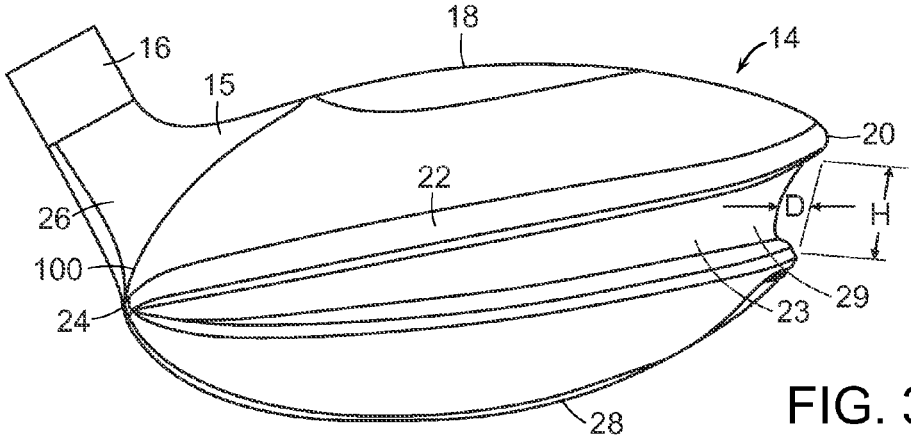
FIG. 3 is a back elevation view of the club head of the golf club of FIG. 1A.
Figure 4:
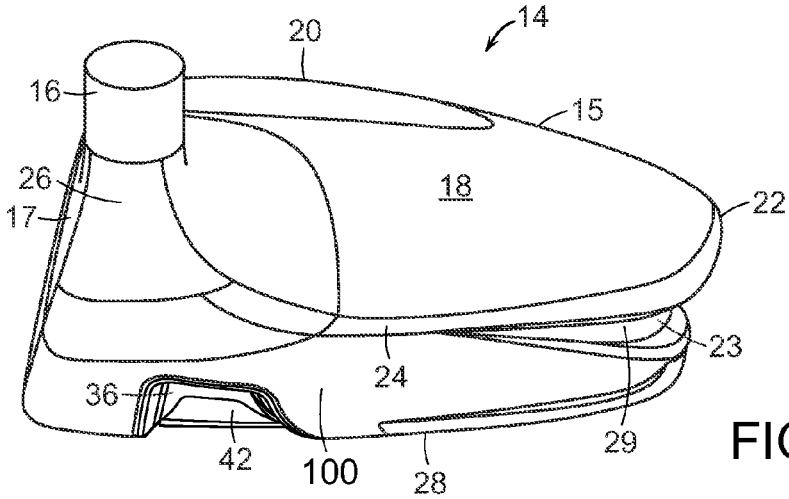
FIG. 4 is a side elevation view of the club head of the golf club of FIG. 1A, viewed from a heel side of the club head.

Referring to FIGS. 3 and 4, the back 22 is positioned opposite the ball striking face 17, is located between the crown 18 and the sole 28, and extends from the heel 24 to the toe 20. When the club head 14 is viewed from the front, i.e., along the $Y_0$-axis in the positive direction, the back 22 cannot be seen. In some golf club head configurations, the back 22 may be provided with a skirt or with a Kammback feature 23.

The heel 24 extends from the ball striking face 17 to the back 22. When the club head 14 is viewed from the toe side, i.e., along the $X_0$-axis in the positive direction, the heel 24 cannot be seen. In some golf club head configurations, the heel 24 may be provided with a skirt or with a Kammback feature 23 or with a portion of a skirt or with a portion of a Kammback feature 23.

The toe 20 is shown as extending from the ball striking face 17 to the back 22 on the side of the club head 14 opposite to the heel 24. When the club head 14 is viewed from the heel side, i.e., along the $X_0$-axis in the negative direction, the toe 20 cannot be seen. In some golf club head configurations, the toe 20 may be provided with a skirt or with a Kammback feature 23 or with a portion of a skirt or with a portion of a Kammback feature 23.

The socket 16 for receiving the shaft is located within the hosel region 26. The hosel region 26 is shown as being located at the intersection of the ball striking face 17, the heel 24, the crown 18 and the sole 28 and may encompass those portions of the heel 24, the crown 18 and the sole 28 that lie adjacent to the hosel 16. Generally, the hosel region 26 includes surfaces that provide a transition from the socket 16 to the ball striking face 17, the heel 24, the crown 18 and/or the sole 28.

Thus it is to be understood that the terms: the ball striking face 17, the crown 18, the toe 20, the back 22, the heel 24, the hosel region 26 and the sole 28, refer to general regions or portions of the body member 15. In some instances, the regions or portions may overlap one another. Further, it is to be understood that the usage of these terms in the present disclosure may differ from the usage of these or similar terms in other documents. It is to be understood that in general, the terms toe, heel, ball striking face and back are intended to refer to the four sides of a golf club, which make up the perimeter outline of a body member when viewed directly from above when the golf club is in the address position.

In the embodiment illustrated in FIGS. 1-6, body member 15 may generally be described as a "square head." Although not a true square in geometric terms, crown 18 and sole 28 of square head body member 15 are substantially square as compared to a traditional round-shaped club head.

Another embodiment of a club head 14 is shown as club head 54 in FIGS. 7-10. Club head 54 has a more traditional round head shape. It is to be appreciated that the phrase "round head" does not refer to a head that is completely round but, rather, one with a generally or substantially round profile.

Figure 11:
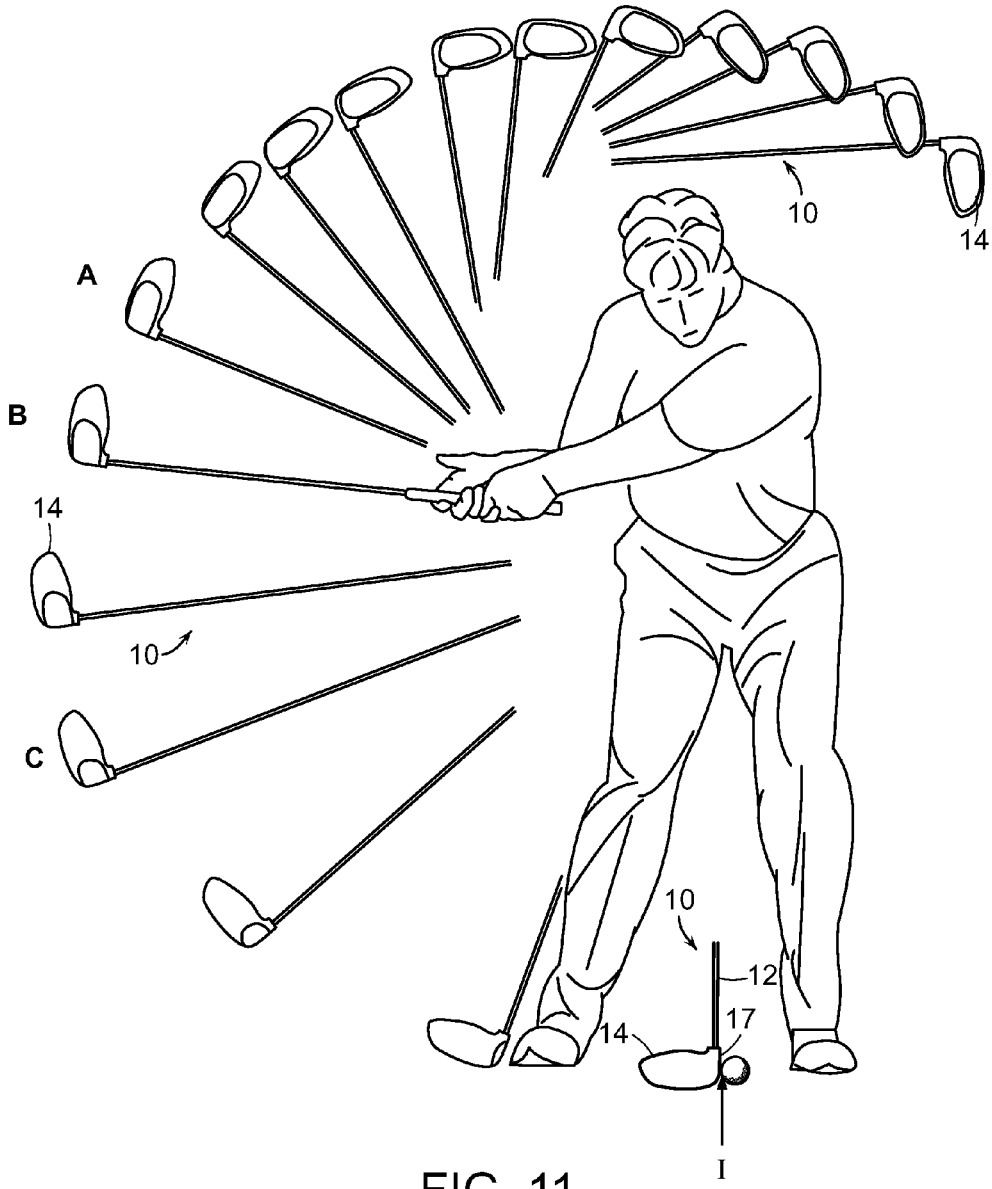
FIG. 11 is a schematic, time-lapsed, front view of a typical golfer's downswing.
Figure 12A:
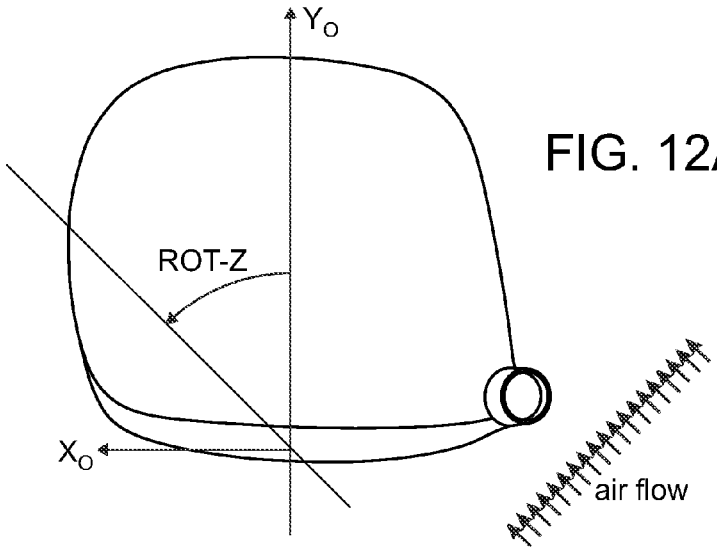
FIG. 12A is a top plan view of a club head illustrating yaw.
Figure 12B:
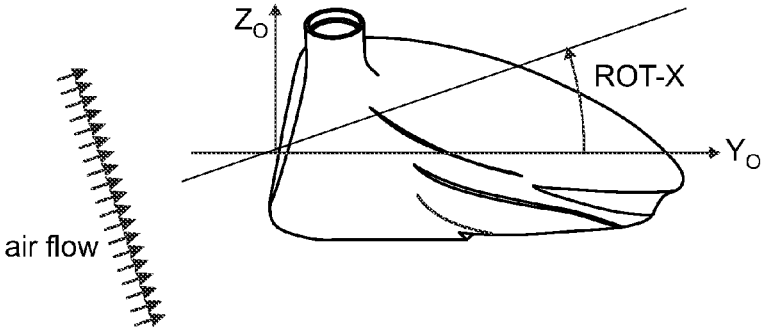
FIG. 12B is a heel-side elevation view of a club head illustrating pitch.
Figure 12C:
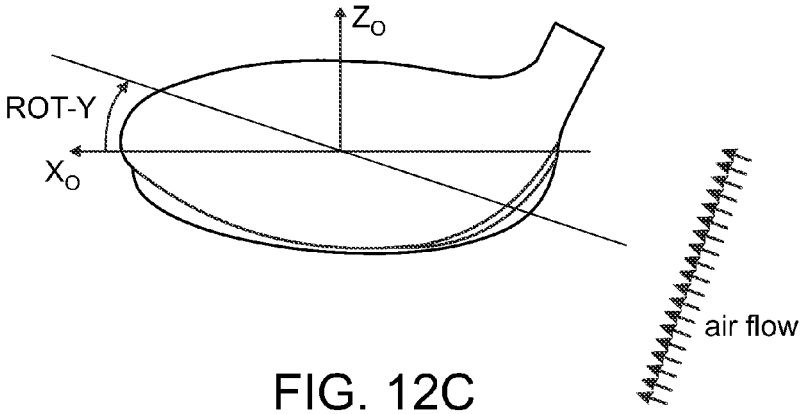
FIG. 12C is a front elevation view of a club head illustrating roll.

FIG. 11 is a schematic front view of a motion capture analysis of at least a portion of a golfer's downswing. As shown in FIG. 11, at the point of impact (I) with a golf ball, the ball striking face 17 may be considered to be substantially perpendicular to the direction of travel of the club head 14. (In actuality, the ball striking face 17 is usually provided with a loft of from approximately 2° to 4°, such that the ball striking face 17 departs from the perpendicular by that amount.) During a golfer's backswing, the ball striking face 17, which starts at the address position, twists outwardly away from the golfer (i.e., clockwise when viewed from above for a right-handed golfer) due to rotation of the golfer's hips, torso, arms, wrists and/or hands. During the downswing, the ball striking face 17 rotates back into the point-of-impact position.

In fact, referring to FIGS. 11 and 12A-12C, during the downswing the club head 14 experiences a change in yaw angle (ROT-Z) (see FIG. 12A) (defined herein as a rotation of the club head 14 around the vertical $Z_0$-axis), a change in pitch angle (ROT-X) (see FIG. 12B) (defined herein as a rotation of the club head 14 around the $X_0$-axis), and a change in roll angle (ROT-Y) (see FIG. 12C) (defined herein as a rotation of the club head 14 around the $Y_0$-axis).

The yaw, pitch, and roll angles may be used to provide the orientation of the club head 14 with respect to the direction of air flow (which is considered to be the opposite direction from the instantaneous trajectory of the club head). At the point of impact and also at the address position, the yaw, pitch and roll angles may be considered to be 0°. For example, referring to FIG. 12A, at a measured yaw angle of 45°, the centerline $L_0$ of the club head 14 is oriented at 45° to the direction of air flow, as viewed along the $Z_0$-axis. As another example, referring to FIG. 12B, at a pitch angle of 20°, the centerline $L_0$ of the club head 14 is oriented at 20° to the direction of air flow, as viewed along the $X_0$-axis. And, referring to FIG. 12C, with a roll angle of 20°, the $X_0$-axis of the club head 14 is oriented at 20° to the direction of air flow, as viewed along the $Y_0$-axis.

Figure 13:
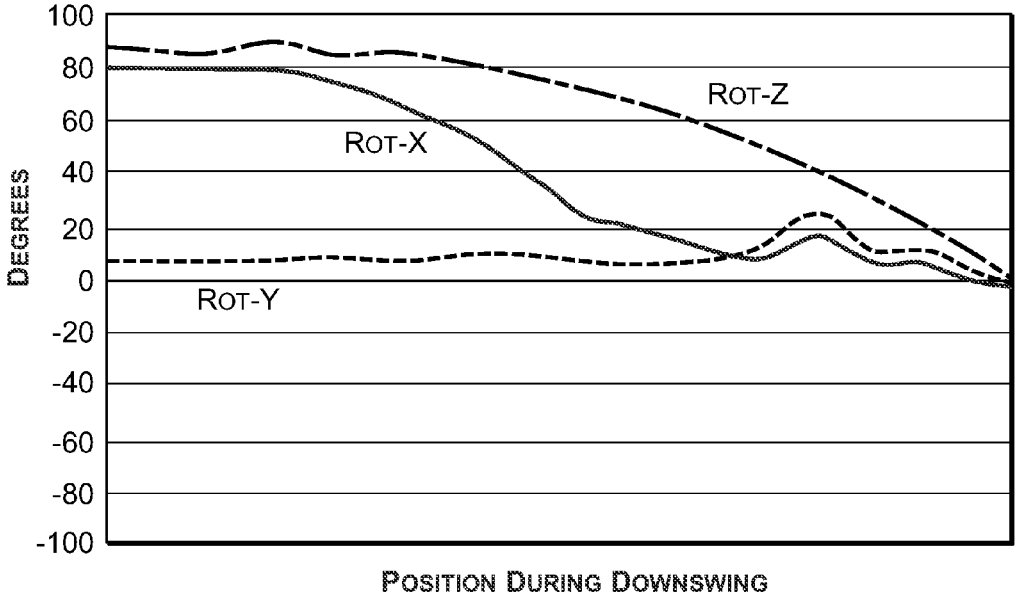
FIG. 13 is a graph of representative yaw, pitch and roll angles as a function of position of a club head during a typical downswing.

FIG. 13 is a graph of representative yaw (ROT-Z), pitch (ROT-X) and roll (ROT-Y) angles as a function of position of a club head 14 during a typical downswing. It can be seen by referring to FIG. 11 and to FIG. 13, that during a large portion of the downswing, the ball striking face 17 of the golf club head 14 is not leading the swing. At the beginning of a golfer's downswing, due to an approximately 90° yaw rotation, the heel 24 may be essentially leading the swing. Even further, at the beginning of a golfer's downswing, due to an approximately 10° roll rotation, the lower portion of the heel 24 is essentially leading the swing. During the downswing, the orientation of the golf club and club head 14 changes from the approximately 90° of yaw at the beginning of the downswing to the approximately 0° of yaw at the point of impact.

Moreover, referring to FIG. 13, typically, the change in yaw angle (ROT-Z) over the course of the downswing is not constant. During the first portion of the downswing, when the club head 14 moves from behind the golfer to a position approximately at shoulder height, the change in yaw angle is typically on the order of 20°. Thus, when the club head 14 is approximately shoulder high, the yaw is approximately 70°. When the club head 14 is approximately waist high, the yaw angle is approximately 60°. During the last 90° portion of the downswing (from waist height to the point of impact), the golf club generally travels through a yaw angle of about 60° to the yaw angle of 0° at the point of impact. However, the change in yaw angle during this portion of the downswing is generally not constant, and, in fact, the golf club head 14 typically closes from approximately a 20° yaw to the 0° yaw at the point of impact only over the last 10° degrees of the downswing. Over the course of this latter 90° portion of the downswing, yaw angles of 45° to 60° may be considered to be representative.

Similarly, still referring to FIG. 13, typically, the change in roll angle (ROT-Y) over the course of the downswing is also not constant. During the first portion of the downswing, when the club head 14 moves from behind the golfer to a position approximately at waist height, the roll angle is fairly constant, for example, on the order of 7° to 13°. However, the change in roll angle during the portion of the downswing from approximately waist height to the point of impact is generally not constant, and, in fact, the golf club head 14 typically has an increase in roll angle from approximately 10° to approximately 20° as the club head 14 swings from approximately waist height to approximately knee height, and then a subsequent decrease in roll angle to 0° at the point of impact. Over the course of a waist-to-knee portion of the downswing, a roll angle of 15° may be considered to be representative.

The speed of the golf club head also changes during the downswing, from 0 mph at the beginning of the downswing to 65 to 100 mph (or more, for top-ranked golfers) at the point of impact. At low speed, i.e., during the initial portion of the downswing, drag due to air resistance may not be very significant. However, during the portion of the downswing when club head 14 is even with the golfer's waist and then swinging through to the point of impact, the club head 14 is travelling at a considerable rate of speed (for example, from 60 mph up to 130 mph for professional golfers). During this portion of the downswing, drag due to air resistance causes the golf club head 14 to impact the golf ball at a slower speed than would be possible without air resistance.

Figure 14C:
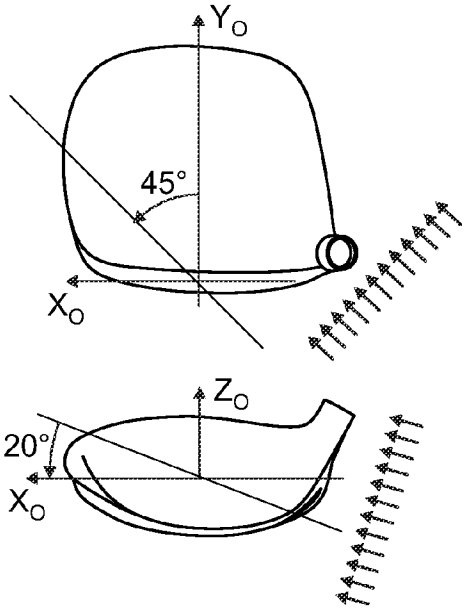
FIGS. 14A-14C schematically illustrate a club head 14 (both top plan view and front elevation view) and typical orientations of the air flow over the club head at points A, B and C of FIG. 11, respectively.
Figure 14B:
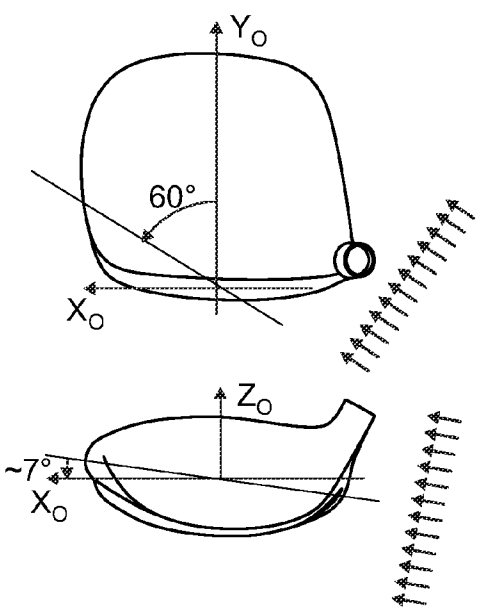
Figure 14A:
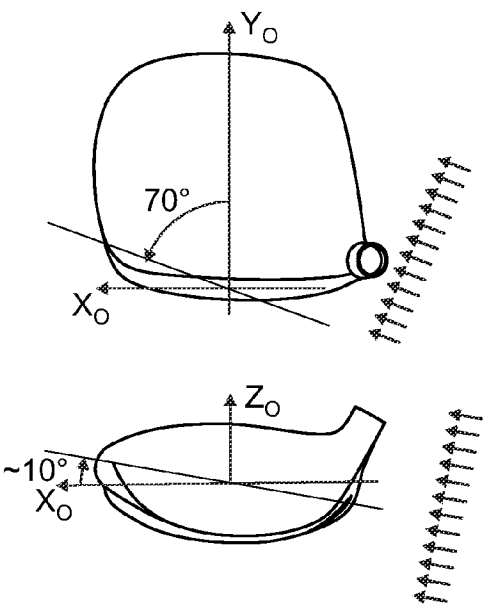
Figure 15:
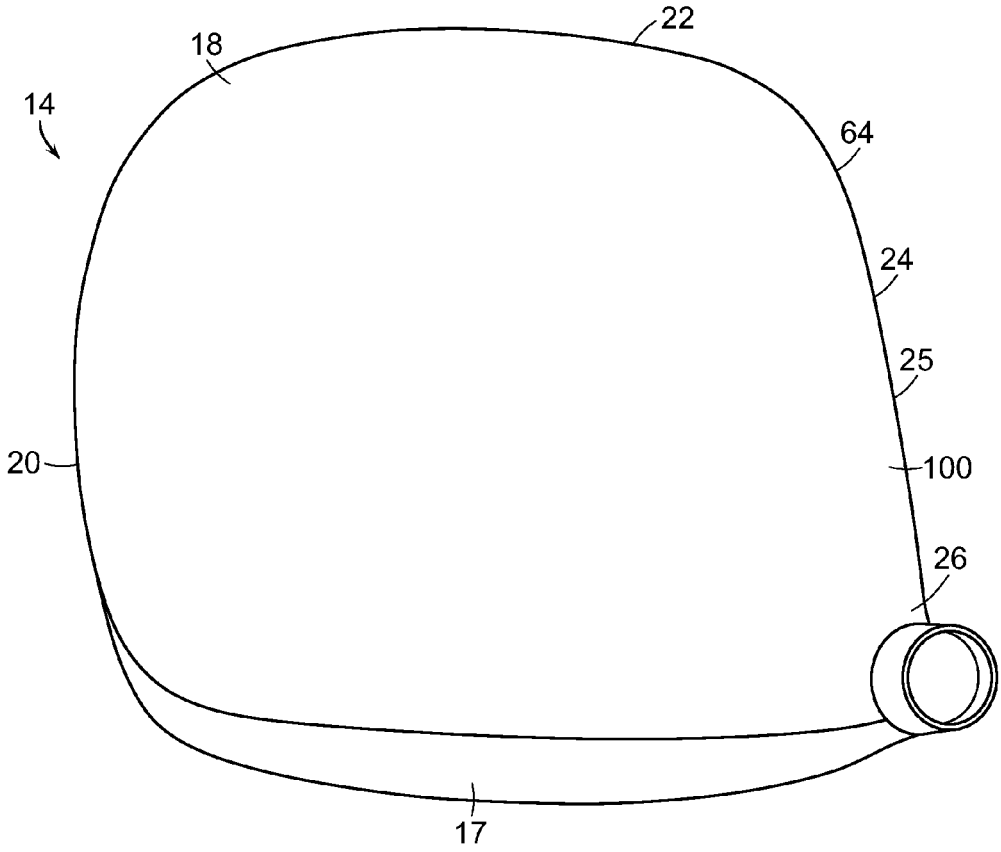
FIG. 15 is a top plan view of a club head according to certain illustrative aspects.
Figure 16:
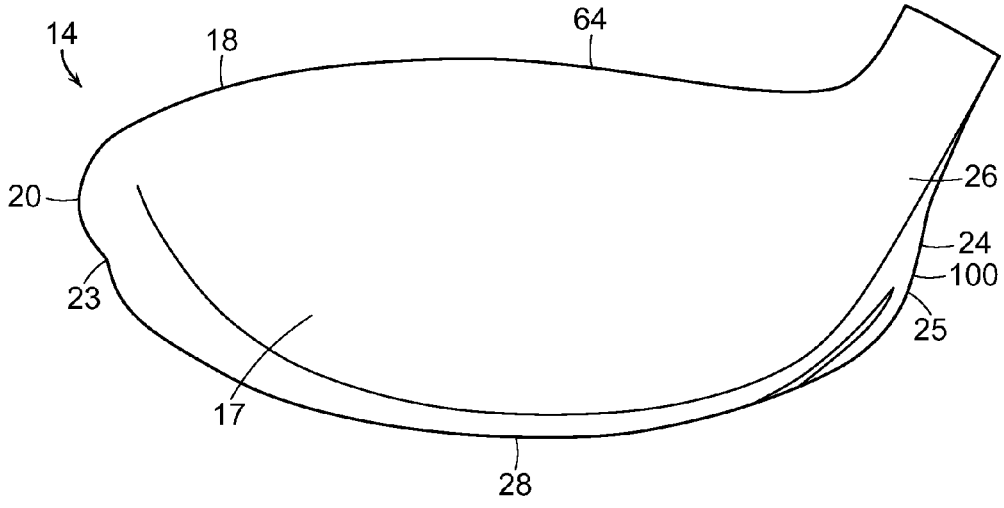
FIG. 16 is a front elevation view of the club head of FIG. 15.

Referring back to FIG. 11, several points (A, B and C) along a golfer's typical downswing have been identified. At point A, the club head 14 is at a downswing angle of approximately 120°, i.e., approximately 120° from the point-of-impact with the golf ball. At this point, the club head may already be traveling at approximately 70% of its maximum velocity. FIG. 14A schematically illustrates a club head 14 and a typical orientation of the air flow over the club head 14 at point A. The yaw angle of the club head 14 may be approximately 70°, meaning that the heel 24 is no longer substantially perpendicular to the air flowing over the club head 14, but rather that the heel 24 is oriented at approximately 20° to the perpendicular to the air flowing over the club head 14. Note also, that at this point in the downswing, the club head 14 may have a roll angle of approximately 7° to 10°, i.e., the heel 24 of the club head 14 is rolled upwards by 7° to 10° relative to the direction of air flow. Thus, the heel 24 (slightly canted to expose the lower (sole side) portion of the heel 24), in conjunction with the heel-side surface of the hosel region 26, leads the swing.

At point B shown on FIG. 11, the club head 14 is at a downswing angle of approximately 100°, i.e., approximately 100° from the point-of-impact with the golf ball. At this point, the club head 14 may now be traveling at approximately 80% of its maximum velocity. FIG. 14B schematically illustrates a club head 14 and a typical orientation of the air flow over the club head 14 at point B. The yaw angle of the club head 14 may be approximately 60°, meaning that the heel 24 is oriented at approximately 30° to the perpendicular to the air flowing over the club head 14. Further, at this point in the downswing, the club head 14 may have a roll angle of approximately 5° to 10°. Thus, the heel 24 is again slightly canted to the expose the lower (sole side) portion of the heel 24. This portion of the heel 24, in conjunction with the heel-side surface of the hosel region 26, and now also with some minor involvement of the striking face-side surface of the hosel region 26, leads the swing. In fact, at this yaw and roll angle orientation, the intersection of the heel-side surface with the striking face-side surface of the hosel region 26 provides the most forward surface (in the trajectory direction). As can be seen, the heel 24 and the hosel region 26 are associated with the leading edge, and the toe 20, a portion of the back 22 adjacent to the toe 20, and/or their intersection are associated with the trailing edge (as defined by the direction of air flow).

At point C of FIG. 11, the club head 14 is at a downswing position of approximately 70°, i.e., approximately 70° from the point of impact with the golf ball. At this point, the club head 14 may now be traveling at approximately 90% or more of its maximum velocity. FIG. 14C schematically illustrates a club head 14 and a typical orientation of the air flow over the club head 14 at point C. The yaw angle of the club head 14 is approximately 45°, meaning that the heel 24 is no longer substantially perpendicular to the air flowing over the club head 14, but rather is oriented at approximately 45° to the perpendicular to the air flow. Further, at this point in the downswing, the club head 14 may have a roll angle of approximately 20°. Thus, the heel 24 (canted by approximately 20° to expose the lower (sole side) portion of the heel 24) in conjunction with the heel-side surface of the hosel region 26, and with even more involvement of the striking face-side surface of the hosel region 26 leads the swing. At this yaw and roll angle orientation, the intersection of the heel-side surface with the striking face-side surface of the hosel region 26 provides the most forward surface (in the trajectory direction). As can be seen, the heel 24 and the hosel region 26 are again associated with the leading edge and a portion of the toe 20 adjacent to the back 22, the portion of the back 22 adjacent to the toe 20 and/or their intersection are associated with the trailing edge (as defined by the direction of air flow).

Referring back to FIGS. 11 and 13, it can be understood that the integration or summation of the drag forces during the entire downswing provides the total drag work experienced by the club head 14. Calculating the percent reduction in the drag work throughout the swing can produce a very different result than calculating the percent reduction in drag force at the point of impact only. The drag-reducing structures described below provide various means to reduce the total drag, not just reducing the drag at the point-of-impact (I).

A further embodiment of the club head 14 is shown as club head 64 in FIGS. 15-20A. Club head 64 is a generally "square head" shaped club. Club head 64 includes ball-striking surface 17, crown 18, a sole 28, a heel 24, a toe 20, a back 22 and a hosel region 26.

Figure 17:
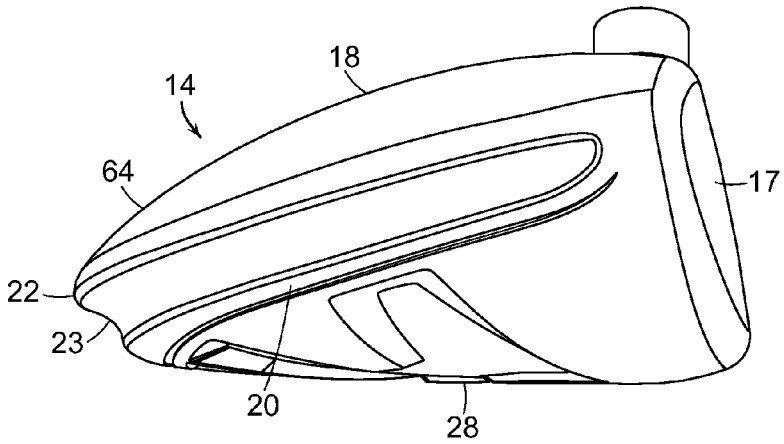
FIG. 17 is a toe-side elevation view of the club head of FIG. 15.
Figure 18:
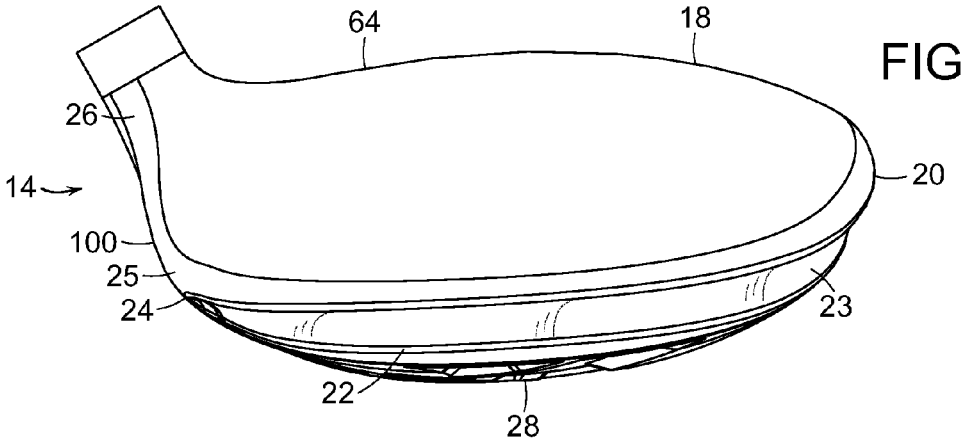
FIG. 18 is a rear-side elevation view of the club head of FIG. 15.
Figure 19:
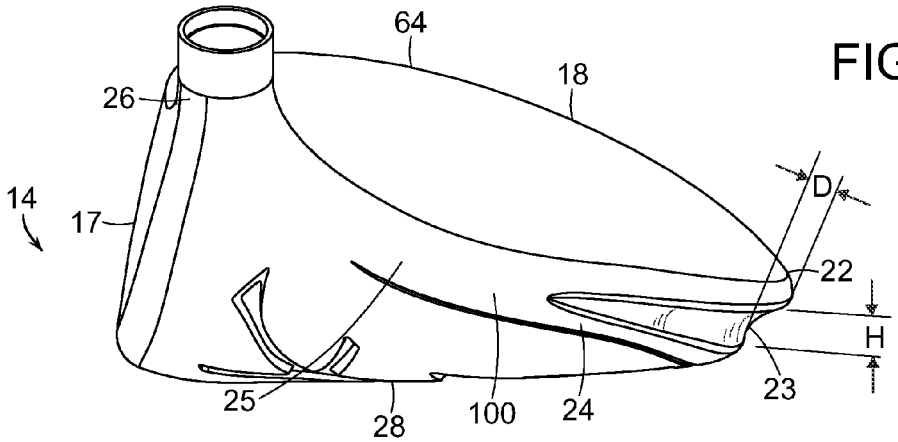
FIG. 19 is a heel-side elevation view of the club head of FIG. 15.

A Kammback feature 23, located between the crown 18 and the sole 28, continuously extends from a forward portion (i.e., a region that is closer to the ball striking face 17 than to the back 22) of the toe 20 to the back 22, across the back 22 to the heel 24 and into a rearward portion of the heel 24. Thus, as best seen in FIG. 17, the Kammback feature 23 extends along a majority of the length of the toe 20. As best seen in FIG. 19, the Kammback feature extends along a minority of the length of the heel 24. In this particular embodiment, Kammback feature 23 is a concave groove having a maximum height (H) that may range from approximately 10 mm to approximately 20 mm and a maximum depth (D) that may range from approximately 5 mm to approximately 15 mm.

Figure 20A:
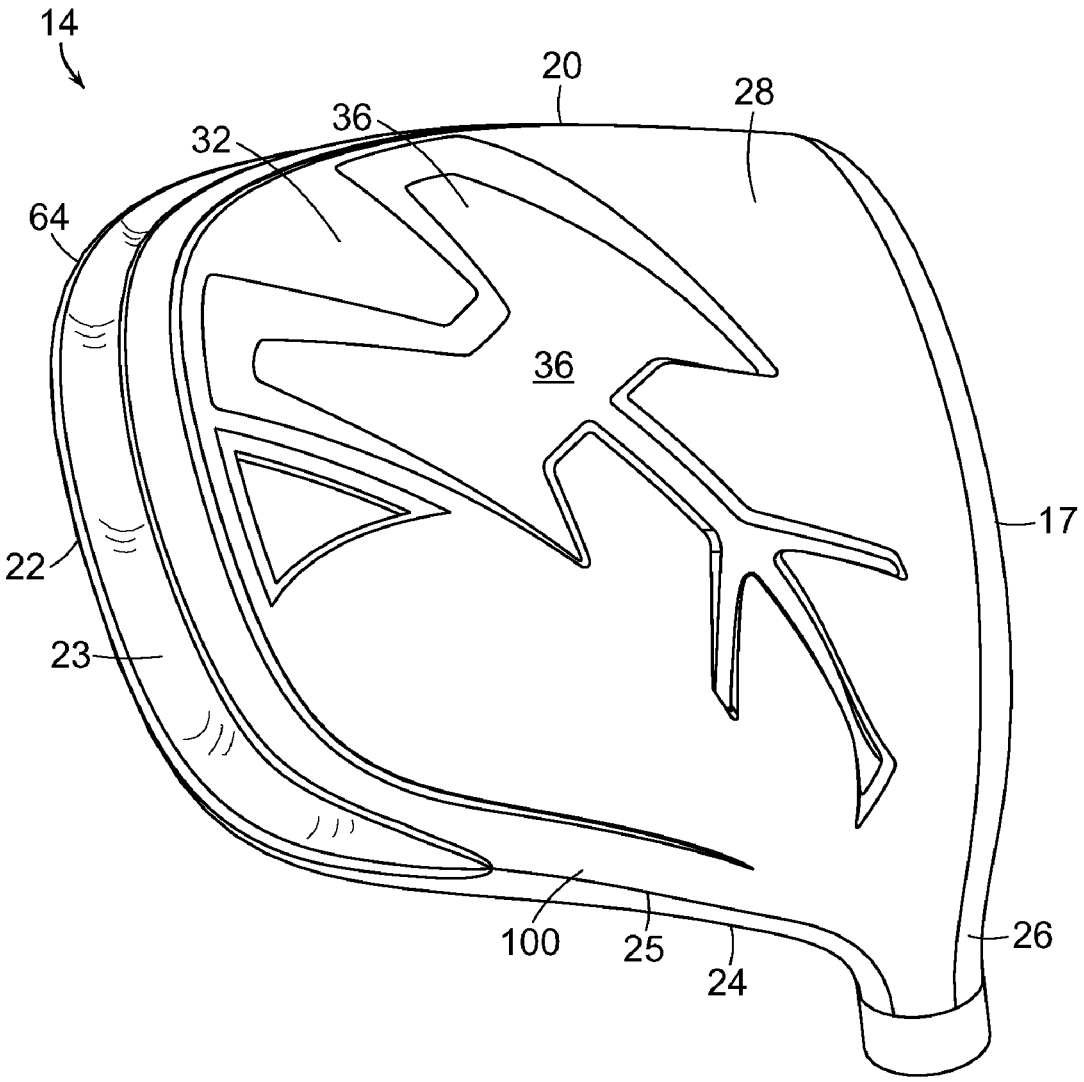
FIG. 20A is a bottom perspective view of the club head of FIG. 15.

One or more diffusers 36 may be formed in sole 28, as shown in FIG. 20A. In an alternative embodiment of club head 14 as shown as club head 74 in FIG. 20B, the sole 28 may be formed without a diffuser.

Referring back to FIGS. 16, 18 and 19, in the heel 24, from the tapered end of the Kammback feature 23 to the hosel region 26, a streamlined region 100 having a surface 25 that is generally shaped as the leading surface of an airfoil may be provided. As disclosed below in greater detail, this streamlined region 100 and the airfoil-like surface 25 may be configured so as to achieve aerodynamic benefits as the air flows over the club head 14 during a downswing stroke of the golf club 10. In particular, the airfoil-like surface 25 of the heel 24 may transition smoothly and gradually into the crown 18. Further, the airfoil-like surface 25 of the heel 24 may transition smoothly and gradually into the sole 28. Even further, the airfoil-like surface 25 of the heel 24 may transition smoothly and gradually into the hosel region 26.

A further embodiment of the club head 14 is shown as club head 84 in FIGS. 21-26A. Club head 84 is a generally "round head" shaped club. Club head 84 includes ball-striking surface 17, crown 18, a sole 28, a heel 24, a toe 20, a back 22 and a hosel region 26.

Figure 23:
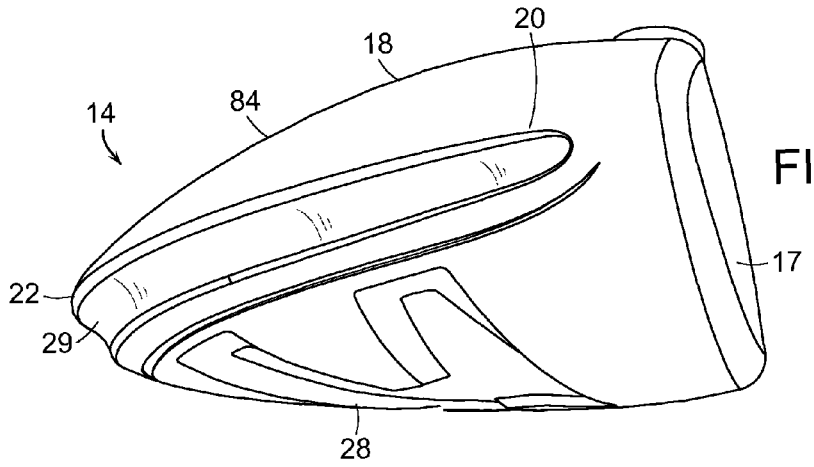
FIG. 23 is a toe-side elevation view of the club head of FIG. 21.
Figure 24:
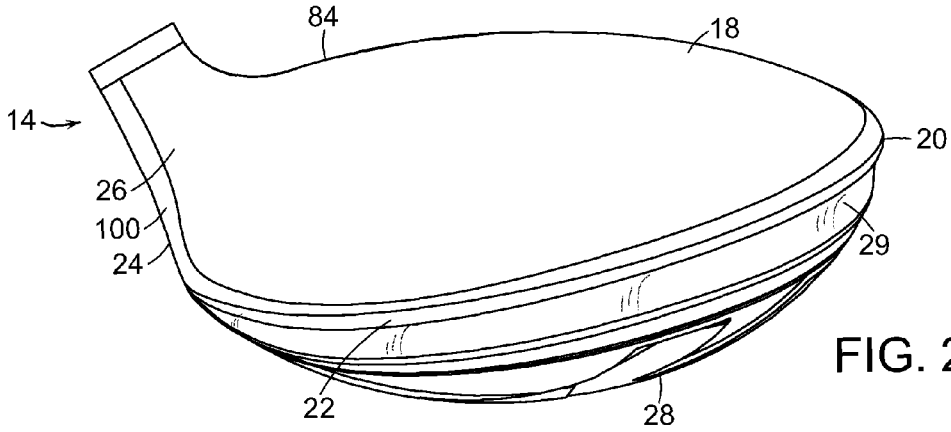
FIG. 24 is a rear-side elevation view of the club head of FIG. 21.
Figure 25:
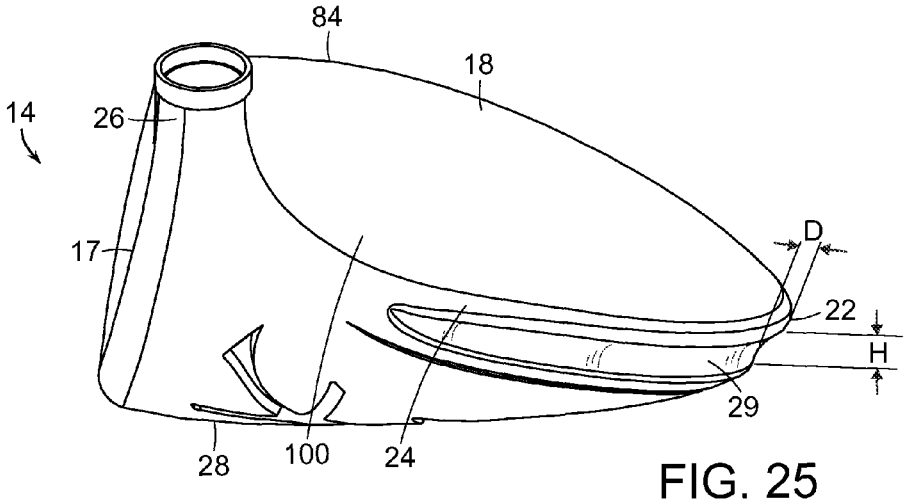
FIG. 25 is a heel-side elevation view of the club head of FIG. 21.

Referring to FIGS. 23-26, a groove 29, located below the outermost edge of the crown 18, continuously extends from a forward portion of the toe 20 to the back 22, across the back 22 to the heel 24 and into a forward portion of the heel 24. Thus, as best seen in FIG. 23, the groove 29 extends along a majority of the length of the toe 20. As best seen in FIG. 25, the groove 29 also extends along a majority of the length of the heel 24. In this particular embodiment, groove 29 is a concave groove having a maximum height (H) that may range from approximately 10 mm to approximately 20 mm and a maximum depth (D) that may range from approximately 5 mm to approximately 10 mm. Further, as best shown in FIG. 26A, sole 28 includes a shallow step 21 that generally parallels groove 29. Step 21 smoothly merges into the surface of the hosel region 26.

Figure 26A:
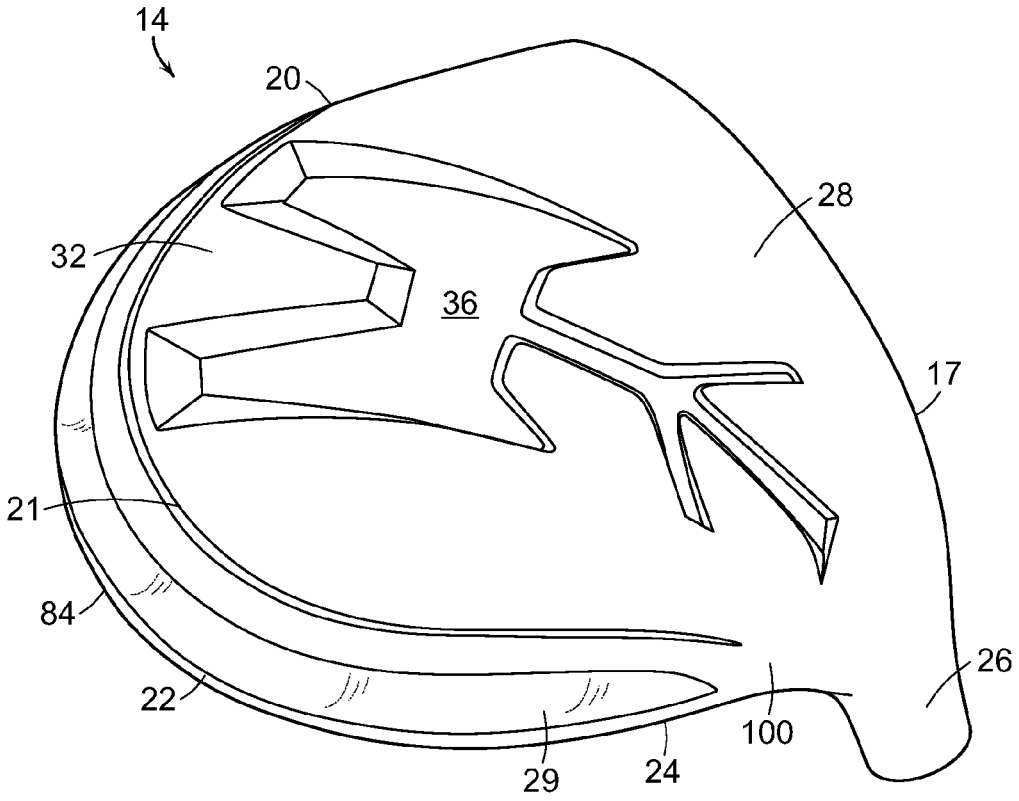
FIG. 26A is a bottom perspective view of the club head of FIG. 21.
Figure 26B:
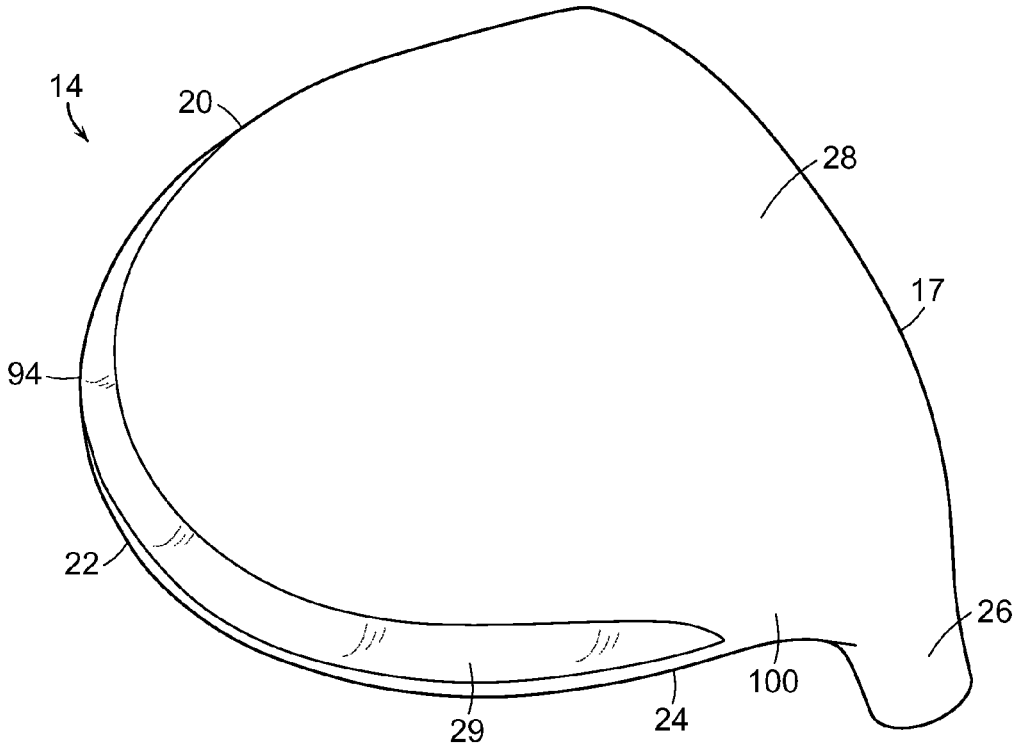
FIG. 26B is a bottom perspective view of an alternative embodiment of a club head that is similar to the club head of FIG. 21, but without a diffuser.

A diffuser 36 may be formed in sole 28, as shown in FIGS. 20A and 26A. In these particular embodiments, diffuser 36 extends from a region of the sole 28 that is adjacent to the hosel region 26 toward the toe 20, the back 22 and the intersection of the toe 22 with the back 22. In an alternative embodiment of club head 14 as shown in FIG. 26B as club head 94, the sole 28 may be formed without a diffuser.

Some of the example drag-reducing structures described in more detail below may provide various means to maintain laminar airflow over one or more of the surfaces of the club head 14 when the ball striking face 17 is generally leading the swing, i.e., when air flows over the club head 14 from the ball striking face 17 toward the back 22. Additionally, some of the example drag-reducing structures described in more detail below may provide various means to maintain laminar airflow over one or more surfaces of the club head 14 when the heel 24 is generally leading the swing, i.e., when air flows over the club head 14 from the heel 24 toward the toe 20. Moreover, some of the example drag-reducing structures described in more detail below may provide various means to maintain laminar airflow over one or more surfaces of the club head 14 when the hosel region 26 is generally leading the swing, i.e., when air flows over the club head 14 from the hosel region 26 toward the toe 20 and/or the back 22. The example drag-reducing structures disclosed herein may be incorporated singly or in combination in club head 14 and are applicable to any and all embodiments of club head 14.

According to certain aspects, and referring, for example, to FIGS. 3-6, 8-10, 15-31, a drag-reducing structure may be provided as a streamlined region 100 located on the heel 24 in the vicinity of (or adjacent to and possibly including a portion of) the hosel region 26. This streamlined region 100 may be configured so as to achieve aerodynamic benefits as the air flows over the club head 14 during a downswing stroke. As described above with respect to FIGS. 11-14, in the latter portion of the downswing, where the velocity of the club head 14 is significant, the club head 14 may rotate through a yaw angle of from approximately 70° to 0°. Further, due to the non-linear nature of the yaw angle rotation, configurations of the heel 24 designed to reduce drag due to airflow when the club head 14 is oriented between the yaw angles of approximately 70° to approximately 45° may achieve the greatest benefits.

Thus, due to the yaw angle rotation during the downswing, it may be advantageous to provide a streamlined region 100 in the heel 24. For example, providing the streamlined region 100 with a smooth, aerodynamically-shaped leading surface may allow air to flow past the club head with minimal disruption. Such a streamlined region 100 may be shaped to minimize resistance to airflow as the air flows from the heel 24 toward the toe 20, toward the back 22, and/or toward the intersection of the back 22 with the toe 20. The streamlined region 100 may be advantageously located on the heel 24 adjacent to, and possibly even overlapping with, the hosel region 26. This streamlined region of the heel 24 may form a portion of the leading surface of the club head 14 over a significant portion of the downswing. The streamlined region 100 may extend along the entire heel 24. Alternatively, the streamlined region 100 may have a more limited extent.

Figure 27:
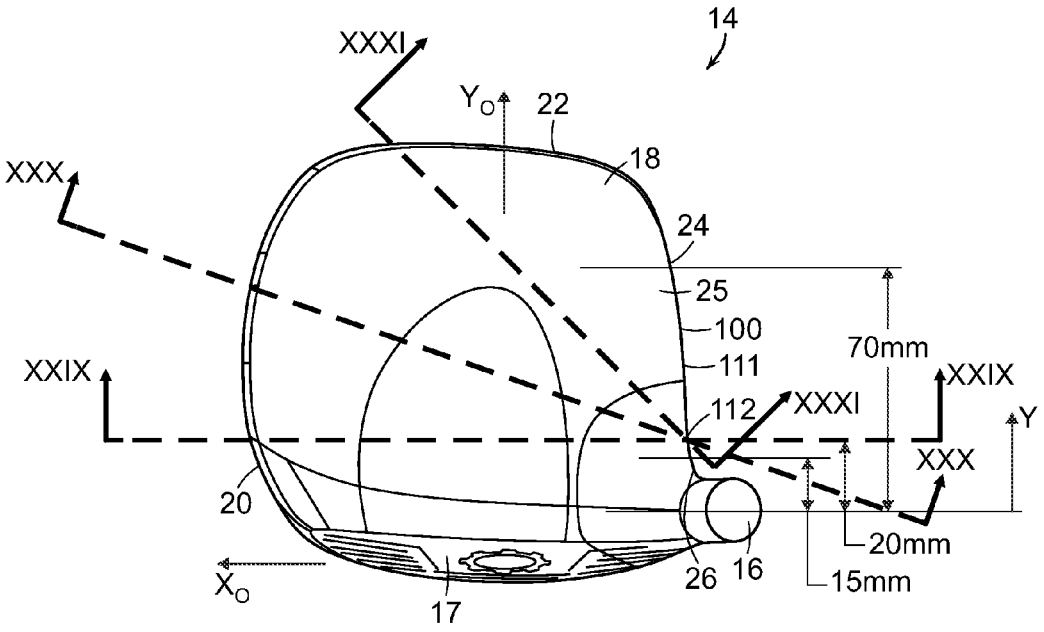
FIG. 27 is a top plan view of the club head of FIGS. 1-6, without a diffuser, in a 60 degree lie angle position, showing cross-sectional cuts taken through point 112.
Figure 28:
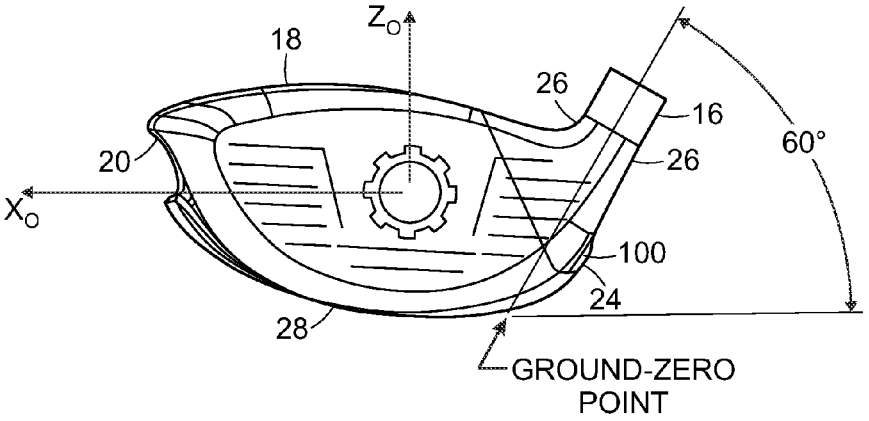
FIG. 28 is a front elevation view of the club head of FIG. 27 in the 60 degree lie angle position.

Referring to FIGS. 27 and 28, according to certain aspects, the streamlined region 100 as, for example, referenced in FIGS. 3-6, 8-10 and 15-31 may be provided at least along the length of the heel 24 from approximately 15 mm to approximately 70 mm in the Y-direction, as measured from a longitudinal axis of the shaft 12 or from where the longitudinal axis of the shaft 12 meets the ground, i.e., at the "ground-zero" point, when the club is at a 60 degree lie angle position with a face angle of zero degrees. In these embodiments, the streamlined region 100 may also optionally extend beyond the enumerated range. For certain other embodiments, the streamlined region 100 may be provided at least from approximately 15 mm to approximately 50 mm in the Y-direction along the length of the heel 24, as measured from the ground-zero point. For further embodiments, the streamlined region 100 may be provided at least from approximately 15 mm to approximately 30 mm, or even at least from approximately 20 mm to approximately 25 mm, in the Y-direction along the length of the heel 24, as measured from the ground-zero point.

Figure 29A:
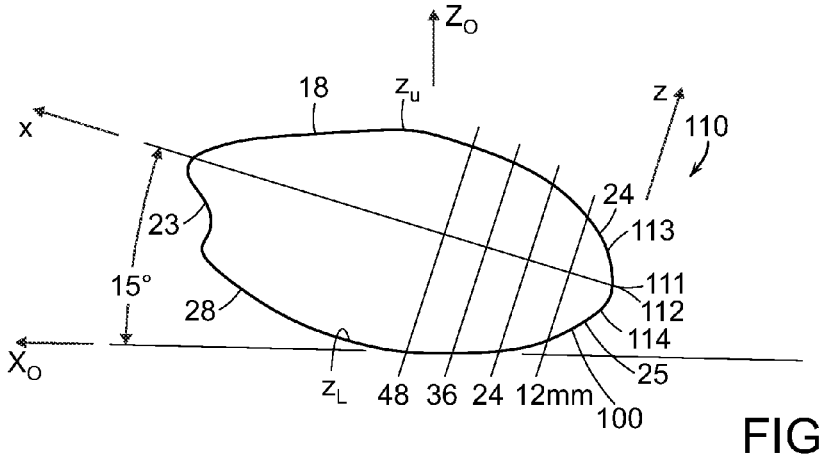
FIGS. 29A and 29B are cross-sectional cuts taken through line XXIX-XXIX of FIG. 27.
Figure 30A:
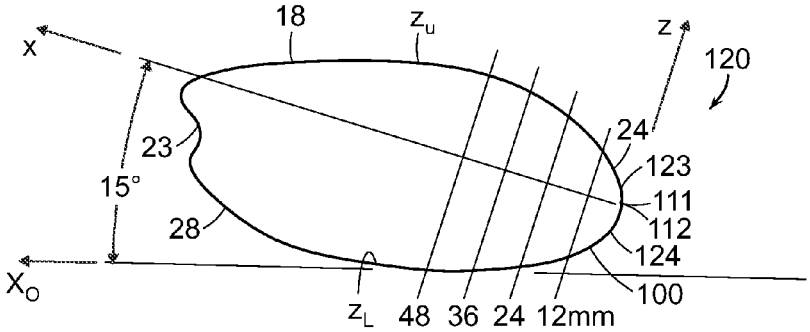
FIGS. 30A and 30B are cross-sectional cuts taken through line XXX-XXX of FIG. 27.
Figure 31A:
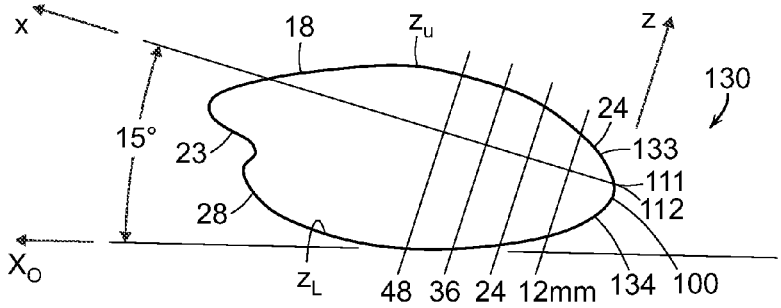
FIGS. 31A and 31B are cross-sectional cuts taken through line XXXI-XXXI of FIG. 27.
Figure 29B:
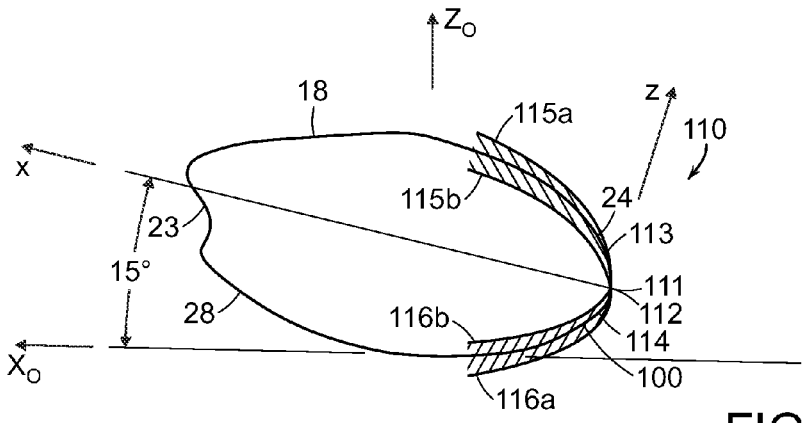
Figure 30B:
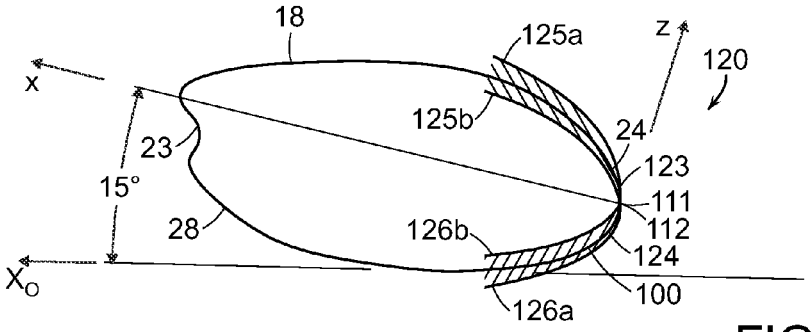
Figure 31B:
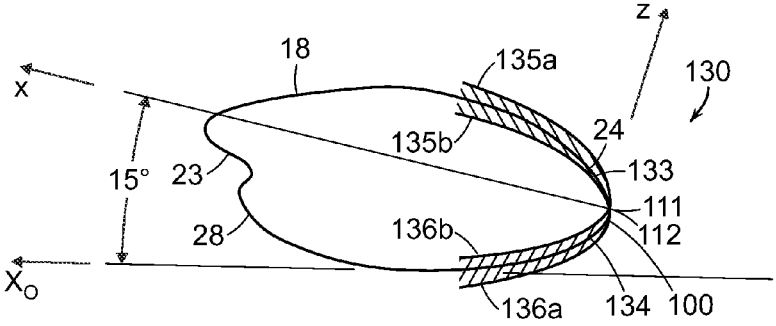

FIG. 27 is shown with three cross-section cuts. The cross-section at line XXIX-XXIX is shown in FIGS. 29A and 29B. The cross-section at line XXX-XXX is shown in FIGS. 30A and 30B. The cross-section at line XXXI-XXXI is shown in FIGS. 31A and 31B. The cross-sections shown in FIGS. 29-31 are used to illustrate specific characteristics of club head 14 of FIGS. 1-6 and are also used to schematically illustrate characteristics of the club head embodiments shown in FIGS. 7-10, FIGS. 15-20 and FIGS. 21-26.

According to certain aspects and referring to FIGS. 29A and 29B, the streamlined region 100 may be defined by a cross-section 110 in the heel 24. FIGS. 29A and 29B illustrate a cross-section 110 of club head 14 taken through line XXIX-XXIX of FIG. 27. A portion of the cross-section 110 cuts through the sole 28, the crown 18 and the heel 24. Further, at least a portion of the cross-section 110 lies within the streamlined region 100, and thus, as discussed above, the leading portion of the cross-section 110 may resemble an airfoil. The cross-section 110 is taken parallel to the $X_0$-axis (i.e., approximately 90 degrees from the $Y_0$-axis (i.e., within a range of ±5 degrees)) in a vertical plane located approximately 20 mm in the Y-direction as measured from the ground-zero point. In other words, the cross-section 110 is oriented perpendicular to the $Y_0$-axis. This cross-section 110 is thus oriented for air flowing over the club head 14 in a direction from the heel 24 to the toe 20.

Referring to FIGS. 27, 29A and 29B, a leading edge 111 is located on the heel 24. The leading edge 111 extends generally from the hosel region 26 toward the back 22 and lies between the crown 18 and the sole 28. If air were to flow parallel to the $X_0$-axis over the club head 14 from the heel 24 toward the toe 20, the leading edge 111 would be the first portion of the heel 24 to experience the air flow. Generally, at the leading edge 111, the slope of the surface of the cross-section 110 is perpendicular to the $X_0$-axis, i.e., the slope is vertical when the club head 14 is at the 60 degree lie angle position.

An apex point 112, which lies on the leading edge 111 of the heel 24 may be defined at Y=20 mm (see FIG. 27). Further, a local coordinate system associated with the cross-section 110 and the apex point 112 may be defined: x- and z-axes extending from the apex point 112 are oriented in the plane of the cross-section 110 at an angle of 15° from the $X_0$- and $Z_0$-axes, respectively, associated with the club head 14. This orientation of the axes at 15° corresponds to the roll angle of 15°, which was considered to be representative over the course of a waist-to-knee portion of the downswing (i.e., when the club head 14 approaches its greatest velocity).

Thus, according to certain aspects, the airfoil-like surface 25 of the streamlined region 100 may be described as being "quasi-parabolic." As used herein, the term "quasi-parabolic" refers to any convex curve having an apex point 112 and two arms that smoothly and gradually curve away from the apex point 112 and from each other on the same side of the apex point. The first arm of the airfoil-like surface 25 may be referred to as a crown-side curve or upper curve 113. The other arm of the airfoil-like surface 25 may be referred to as a sole-side curve or lower curve 114. For example, a branch of a hyperbolic curve may be considered to be quasi-parabolic. Further, as used herein, a quasi-parabolic cross-section need not be symmetric. For example, one arm of the quasi-parabolic cross-section may be most closely represented by a parabolic curve, while the other arm may be most closely represented by a hyperbolic curve. As another example, the apex point 112 need not be centered between the two arms. In which case, the term "apex point" refers to the leading point of the quasi-parabolic curve, i.e., the point from which the two curves 113, 114 curve away from each other. In other words, a "quasi-parabolic" curve oriented with the arms extending horizontally in the same direction has a maximum slope at the apex point 112 and the absolute values of the slope of the curves 113, 114 gradually and continuously decrease as the horizontal distance from the apex point 112 increases.

FIGS. 30A and 30B illustrate a cross-section 120 of club head 14 taken through line XXX-XXX of FIG. 27. According to certain aspects and referring to FIGS. 30A and 30B, the streamlined region 100 may be defined by its cross-section 120 in the heel 24. The cross-section 120 is taken at an angle of approximately 70 degrees (i.e., within a range of ±5 degrees) to the $Y_0$-axis, rotated around the apex point 112, as shown in FIG. 27. This cross-section 120 is thus also oriented for air flowing over the club head 14 in a direction from the heel 24 to the toe 20, but now with the direction of airflow angled more toward the intersection of the toe 20 with the back 22 as compared to the cross-section 110 (refer to FIG. 14 A). Similar to the cross-section 110, the cross-section 120 includes a crown-side curve or upper curve 123 extending from the apex point 112 and a sole-side curve or lower curve 124 also extending from the apex point. The apex point 112, which is associated with the leading edge 111 of the heel 24 at Y=20 mm, is shown.

The x- and z-axes associated with cross-section 120 are oriented in the plane of the cross-section 120 at an angle of 15° from the $X_0$- and $Z_0$-axes, respectively, associated with the club head 14. Once again, this orientation of the cross-sectional axes at 15° corresponds to a roll angle of 15°, which was considered to be representative over the course of a waist-to-knee portion of the downswing (i.e., when the club head 14 approaches its greatest velocity).

FIGS. 31A and 31B illustrate a cross-section 130 of club head 14 taken through line XXXI-XXXI of FIG. 27. According to certain aspects and referring to FIGS. 31A and 31B, the streamlined region 100 may be defined by its cross-section 130 in the heel 24. As discussed above, the cross-section 130 of the streamlined region 100 may resemble the leading edge of an airfoil. The cross-section 130 is taken at an angle of approximately 45 degrees (i.e., within a range of ±5 degrees) to the Y-axis, rotated around the apex point 112, as shown in FIG. 27. This cross-section 130 is thus oriented for air flowing over the club head 14 generally in a direction from the heel 24 to the back 22 (refer to FIG. 14C). Similar to the cross-sections 110 and 120, the cross-section 130 also includes a crown-side curve or upper curve 133 extending from the apex point 112 and a sole-side curve or lower curve 134 also extending from the apex point. The apex point 112, which is associated with the leading edge 111 of the heel 24 at Y=20 mm, as measured from the ground-zero point, is shown.

The x- and z-axes associated with cross-section 130 are oriented in the plane of the cross-section 130 at an angle of 15° from the $X_0$- and $Z_0$-axes, respectively, associated with the club head 14. Once again, this orientation of the cross-sectional axes at 15° corresponds to a roll angle of 15°, which was considered to be representative over the course of a waist-to-knee portion of the downswing (i.e., when the club head 14 approaches its greatest velocity).

Referring to FIGS. 29A, 30A and 31A, a person of ordinary skill in the art would recognize that one way to characterize the shape of a curve is by providing a table of spline points. For purposes of these spline point tables, the apex point 112 is defined at (0, 0) and all of the coordinates of the spline points are defined relative to the apex point 112. FIGS. 29A, 30A and 31A include x-axis coordinate lines at 12 mm, 24 mm, 36 mm, 48 mm at which spline points may be defined. Although spline points may be defined at other x-axis coordinates, for example, at 3 mm, 6 mm and 18 mm, such coordinate lines are not included in FIGS. 29A, 30A and 31A for purposes of clarity.

As shown in FIGS. 29A, 30A and 31A, the $z_U$-coordinates are associated with the upper curves 113, 123, 133; the $z_L$-coordinates are associated with the lower curves 114, 124, 134. The upper curves are generally not the same as the lower curves. In other words, the cross-sections 110, 120, 130 may be non-symmetric. As can be seen from examining FIGS. 29A, 30A and 31A, this non-symmetry, i.e. the differences between the upper and lower curves, may become more pronounced as the cross-sections swing toward the back of the club head. Specifically, the upper and lower curves of the cross-section taken at an angle of approximately 90 degrees to the centerline (see, e.g., FIG. 29A) may be more symmetrical than the upper and lower curves of the cross-section taken at an angle of approximately 45 degrees to the centerline (see, e.g., FIG. 31A). Furthermore, again referring to FIGS. 29A, 30A and 31A, the lower curves may, for some example embodiments, remain relatively constant as the cross-section swings toward the back of the club head, while the upper curves may flatten out.

Referring to FIGS. 29B, 30B and 31B, a person of ordinary skill in the art would recognize that another way to characterize a curve is by fitting the curve to one or more functions. For example, because of the asymmetry of the upper and lower curves as discussed above, the upper and lower curves of cross-sections 110, 120, 130 may be independently curve fit using polynomial functions. Thus, according to certain aspects, second-order or third-order polynomials, i.e., quadratic or cubic functions, may sufficiently characterize the curves.

For example, a quadratic function may be determined with the vertex of the quadratic function being constrained to be the apex point 112, i.e., the (0, 0) point. In other words, the curve fit may require that the quadratic function extend through the apex point 112. Further the curve fit may require that the quadratic function be perpendicular to the x-axis at the apex point 112.

Another mathematical technique that may be used to curve fit involves the use of Bézier curves, which are parametric curves that may be used to model smooth curves. Bézier curves, for example, are commonly used in computer numerical control (CNC) machines for controlling the machining of complex smooth curves.

Using Bézier curves, the following generalized parametric curves may be used to obtain, respectively, the x- and z-coordinates of the upper curve of the cross-section:

$$x_U=(1-t)^3\,Pxu_0+3\,(1-t)^2\,t\,Pxu_1+3\,(1-t)\,t^2\,Pxu_2+t^3\,Pxu_3 \qquad \text{Equ. (1a)}$$

$$z_U=(1-t)^3\,Pzu_0+3\,(1-t)^2\,t\,Pzu_1+3\,(1-t)\,t^2\,Pzu_2+t^3\,Pzu_3 \qquad \text{Equ. (1b)}$$

over the range of: $0 \leqq t \leqq 1$.

$Pxu_0$, $Pxu_1$, $Pxu_2$ and $Pxu_3$ are the control points for the Bézier curve for the x-coordinates associated with the upper curve, and $Pzu_0$, $Pzu_1$, $Pzu_2$ and $Pzu_3$ are the control points for the Bézier curve for the z-coordinates associated with the upper curve.

Similarly, the following generalized parametric Bézier curves may be used to obtain, respectively, the x- and z-coordinates of the lower curve of the cross-section:

$$x_L=(1-t)^3\,P_{XL_0}+3\,(1-t)^2\,t\,P_{XL_1}+3\,(1-t)\,t^2\,P_{XL_2}+t^3\,P_{XL_3} \qquad \text{Equ. (2a)}$$

$$z_L=(1-t)^3\,P_{ZL_0}+3\,(1-t)^2\,t\,P_{ZL_1}+3\,(1-t)\,t^2\,P_{ZL_2}+t^3\,P_{ZL_3} \qquad \text{Equ. (2b)}$$

over the range of: $0 \leqq t \leqq 1$.

$P_{XL_0}$, $P_{XL_1}$, $P_{XL_2}$ and $P_{XL_3}$ are the control points for the Bézier curve for the x-coordinates associated with the lower curve, and $P_{ZL_0}$, $P_{ZL_1}$, $P_{ZL_2}$ and $P_{ZL_3}$ are the control points for the Bézier curve for the z-coordinates associated with the lower curve.

Since curve fits are used to generally fit the data, one way to capture the data may be to provide curves that bound the data. Thus, for example, referring to FIGS. 29B, 30B, 31B, each of the upper and lower curves of cross-sections 110, 120, 130 may be characterized as residing within a region bounded by a pair of curves (115*a*, 115*b*), (116*a*, 116*b*), (125*a*, 125*b*), (126*a*, 126*b*), (135*a*, 135*b*), (136*a*, 136*b*) wherein the pairs of curves may, for example, represent a variation in the z-coordinates of the curves 113, 114, 123, 124, 133 and 134, respectively, of up to ±10%, or even up to 20%.

Further, it is noted that the cross-sections 110, 120 and 130 presented in FIGS. 29-31 are for a club head 14 without a diffuser 36 provided on the sole 28. According to certain aspects, a diffuser 36 may be provided on the sole 28, and as such, the lower curves of the cross-sections 110, 120 and/or 130 would vary from the shapes presented in FIGS. 29-31. Even further, according to certain aspects, each of the cross-sections 110, 120 and 130 may include a Kammback feature 23 at their trailing edge.

Referring back to FIGS. 27 and 28, it is noted that the apex point 112, which is associated with the leading edge 111 of the heel 24 at Y=20 mm (see FIG. 27), was used to assist in the description of the cross-sections 110, 120 and 130 (see FIGS. 29-31). However, the apex point 112 need not be positioned precisely at Y=20 mm. In the more general case, according to certain aspects, the apex point 112 may be position from approximately 10 mm to approximately 30 mm in the Y-direction as measured from the "ground-zero" point. For some embodiments, the apex point 112 may be position from approximately 15 mm to approximately 25 mm in the Y-direction as measured from the "ground-zero" point. A variation of plus or minus a millimeter in the location of the apex point may be considered acceptable. According to certain embodiments, the apex point 112 may be positioned on the leading edge 111 of the heel 24 in the forward half of the club head 14.

Figure 20B:
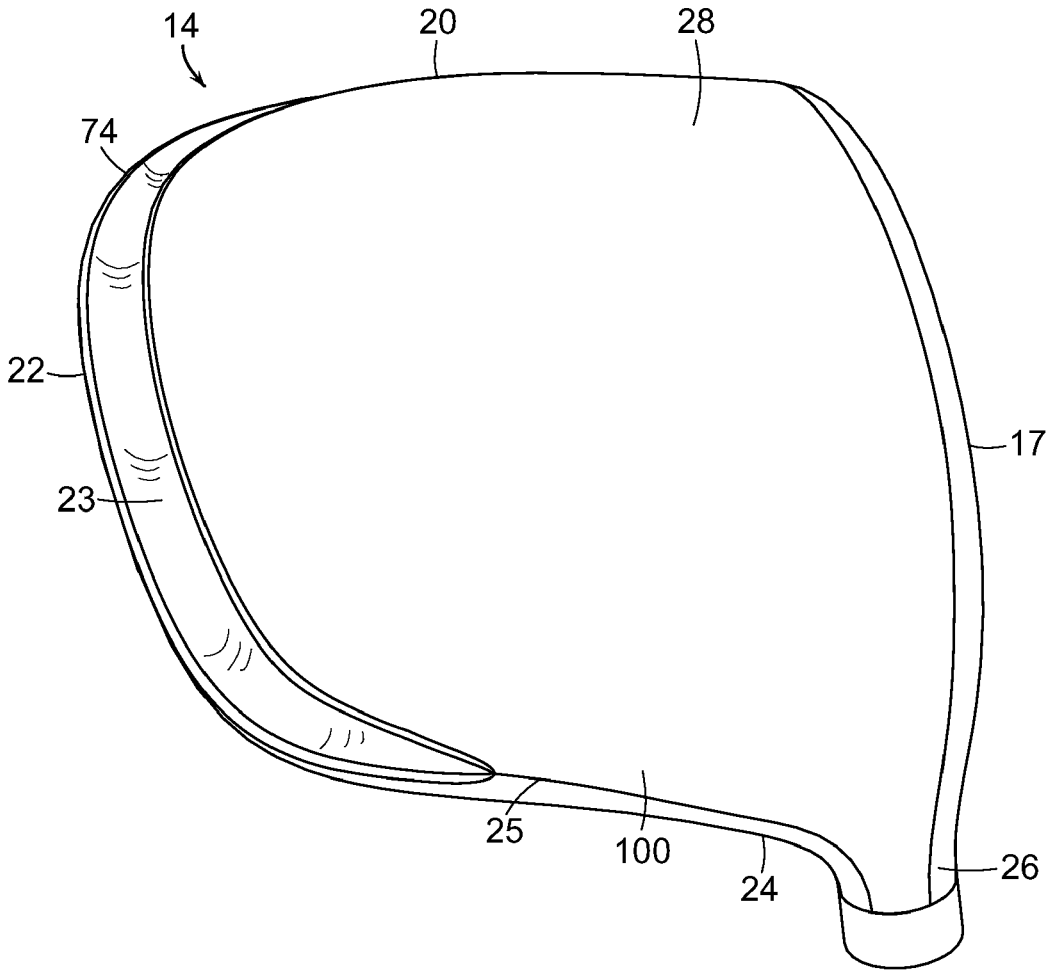
FIG. 20B is a bottom perspective view of an alternative embodiment of a club head that is similar to the club head of FIG. 15, but without a diffuser.
Figure 21:
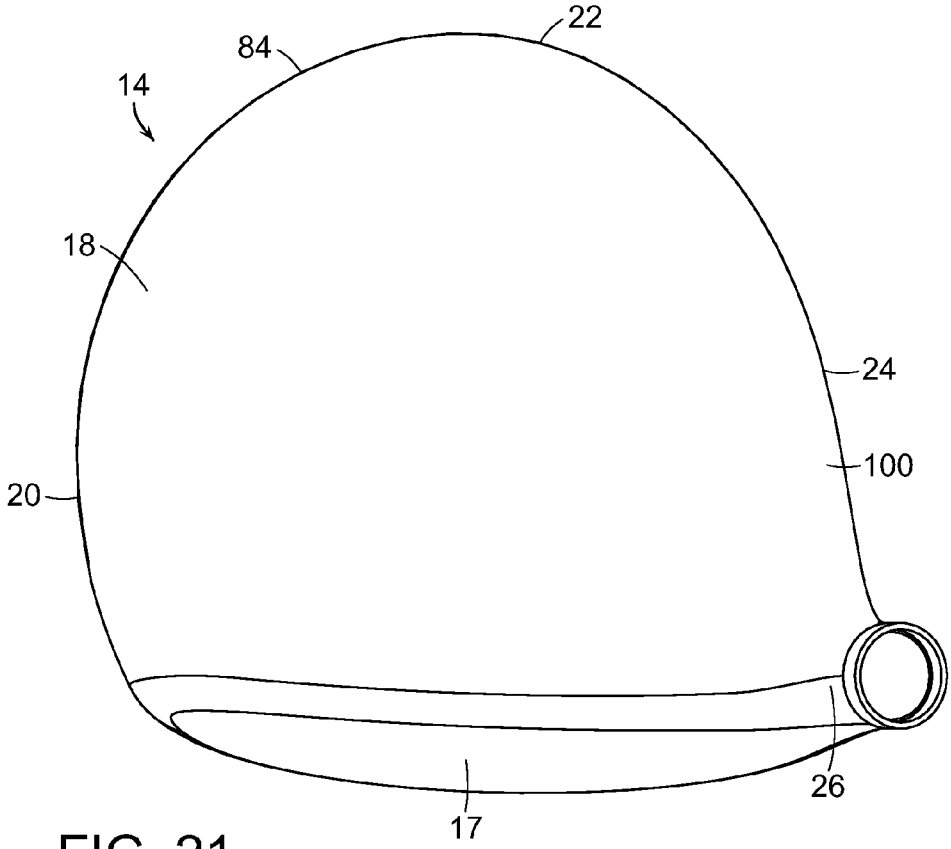
FIG. 21 is a top plan view of a club head according to other illustrative aspects.
Figure 22:
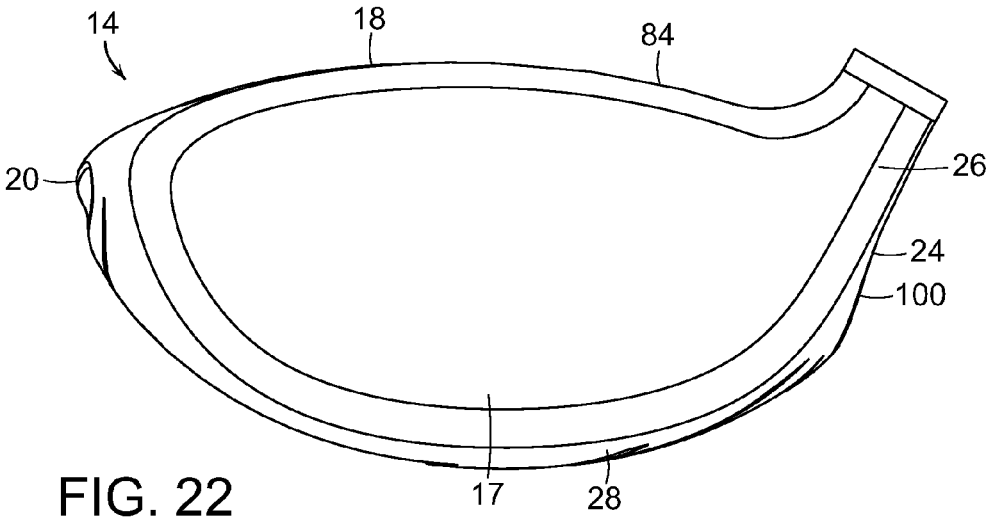
FIG. 22 is a front elevation view of the club head of FIG. 21.

According to certain aspects and as best shown in FIG. 20B, the sole 28 may extend across the width of the club head 14, from the heel 24 to the toe 20, with a generally convex, gradual, widthwise curvature. Further, the smooth and uninterrupted, airfoil-like surface 25 of the heel 24 may continue into, and even beyond, a central region of the sole 28. The sole's generally convex, widthwise, curvature may extend all the way across the sole 28 to the toe 20. In other words, the sole 28 may be provided with a convex curvature across its entire width, from the heel 24 to the toe 20.

Further, the sole 28 may extend across the length of the club head 14, from the ball striking face 17 to the back 22, with a generally convex smooth curvature. This generally convex curvature may extend from adjacent the ball striking surface 17 to the back 22 without transitioning from a positive to a negative curvature. In other words, the sole 28 may be provided with a convex curvature along its entire length from the ball striking face 17 to the back 22.

Figure 5:
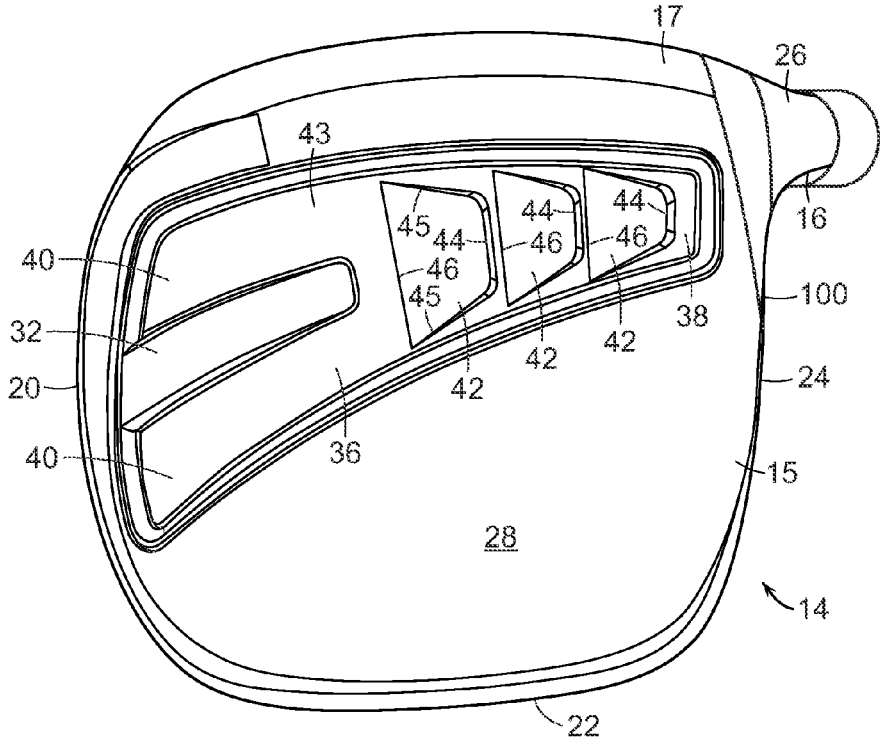
FIG. 5 is a plan view of the sole of the club head of the golf club of FIG. 1A.

Alternatively, according to certain aspects, as illustrated, for example, in FIGS. 5, 20A and 26A, a recess or diffuser 36 may be formed in sole 28. In the illustrated embodiment of FIG. 5, recess or diffuser 36 is substantially V-shaped with a vertex 38 of its shape being positioned proximate ball striking face 17 and heel 24. That is, vertex 38 is positioned close to ball striking face 17 and heel 24 and away from skirt or Kammback feature 23 and toe 20. Recess or diffuser 36 includes a pair of legs 40 extending to a point proximate toe 20 and away from ball striking face 17, and curving toward skirt or Kammback feature 23 and away from ball striking face 17.

Still referring to FIG. 5, a plurality of secondary recesses 42 may be formed in a bottom surface 43 of recess or diffuser 36. In the illustrated embodiment, each secondary recess 42 is a regular trapezoid, with its smaller base 44 closer to heel 24 and its larger base 46 closer to toe 20, and angled sides 45 joining smaller base 44 to larger base 46. In the illustrated embodiment a depth of each secondary recess 42 varies from its largest amount at smaller base 44 to larger base 46, which is flush with bottom surface 43 of recess or diffuser 36.

Thus, according to certain aspects and as best shown in FIGS. 5, 20A and 26A, diffuser 36 may extend from adjacent the hosel region 26 toward the toe 20, toward the intersection of the toe 20 with the back 22 and/or toward the back 22. The cross-sectional area of the diffuser 36 may gradually increase as the diffuser 36 extends away from the hosel region 26. It is expected than any adverse pressure gradient building up in an air stream flowing from the hosel region 26 toward the toe 20 and/or toward the back 22 will be mitigated by the increase in cross-sectional area of the diffuser 36. Thus, it is expected that any transition from the laminar flow regime to the turbulent flow regime of the air flowing over the sole 28 will be delayed or even eliminated altogether. In certain configurations, the sole 28 may include multiple diffusers.

The one or more diffusers 36 may be oriented to mitigate drag during at least some portion of the downswing stroke, particularly as the club head 14 rotates around the yaw axis. The sides of the diffuser 36 may be straight or curved. In certain configurations, the diffuser 36 may be oriented at an angle from the $Y_0$-axis in order to diffuse the air flow (i.e., reduce the adverse pressure gradient) when the hosel region 26 and/or the heel 24 lead the swing. The diffuser 36 may be oriented at angles that range from approximately 10° to approximately 80° from the $Y_0$-axis. Optionally, the diffuser 36 may be oriented at angles that range from approximately 20° to approximately 70°, or from approximately 30° to approximately 70°, or from approximately 40° to approximately 70°, or even from approximately 45° to approximately 65° from the $T_0$ direction. Thus, in certain configurations, the diffuser 36 may extend from the hosel region 26 toward the toe 20 and/or toward the back 22. In other configurations, the diffuser 36 may extend from the heel 24 toward the toe 20 and/or the back 22.

Optionally, as shown in FIGS. 5, 20A and 26, the diffuser 36 may include one or more vanes 32. The vane 32 may be located approximately centered between the sides of the diffuser 36. In certain configurations (not shown), the diffuser 36 may include multiple vanes. In other configurations, the diffuser 36 need not include any vane. Even further, the vane 32 may extend substantially along the entire length of the diffuser 36 or only partially along the length of the diffuser 36.

Figure 2:
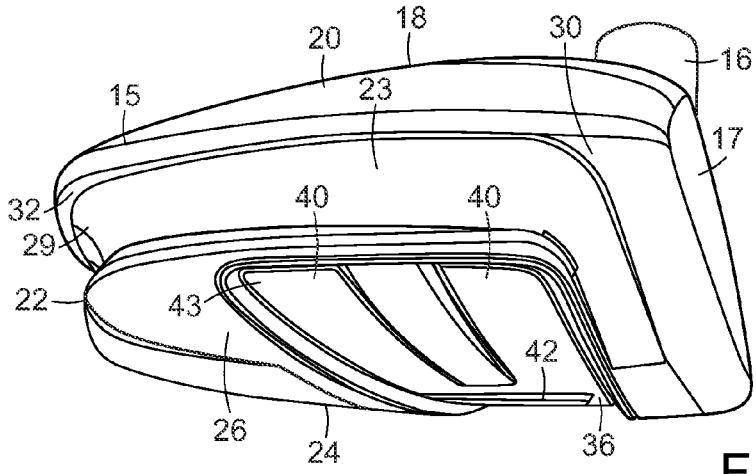
FIG. 2 is a side perspective view of the club head of the golf club of FIG. 1A.
Figure 6:
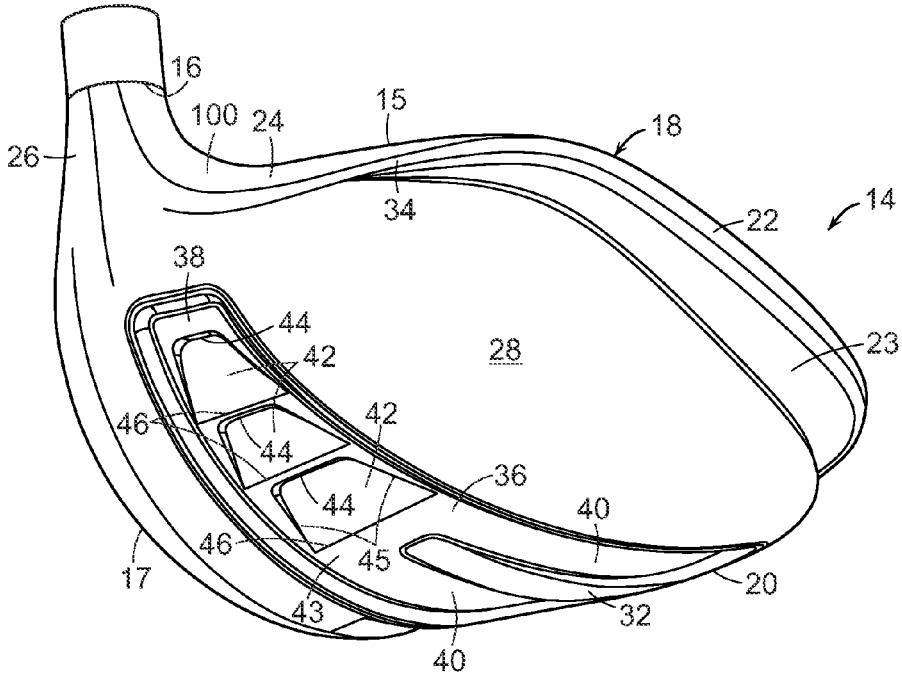
FIG. 6 is a bottom perspective view of the club head of the golf club of FIG. 1A.
Figure 8:
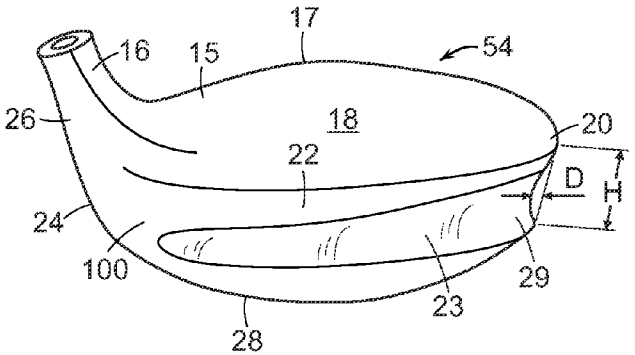
FIG. 8 is a back elevation view of the club head of FIG. 7.
Figure 10:
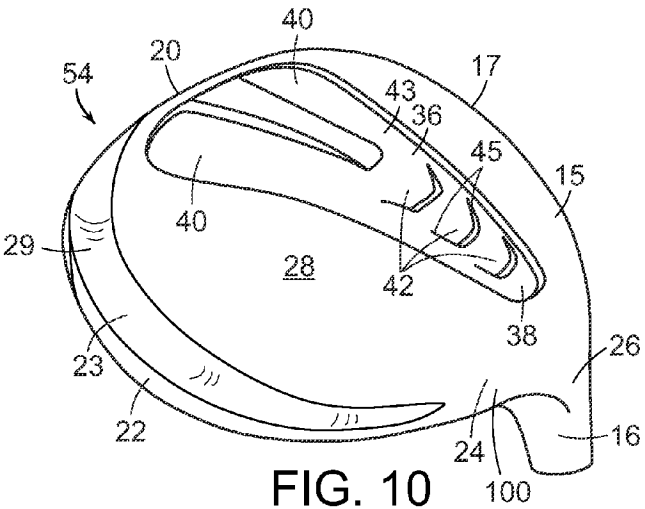
FIG. 10 is a bottom perspective view of the club head of FIG. 7.
Figure 7:
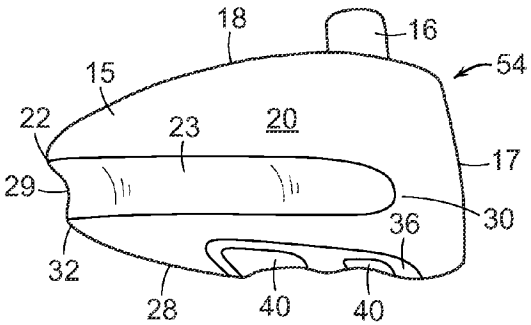
FIG. 7 is a side elevation view of an alternative embodiment of the club head of the golf club of FIG. 1A, viewed from a toe side of the club head.

As shown, according to one embodiment, in FIGS. 1-4 and 6, the club head 14 may include the "Kammback" feature 23. The Kammback feature 23 may extend from the crown 18 to the sole 28. As shown in FIGS. 3 and 6, the Kammback feature 23 extends across the back 22 from the heel 24 to the toe 20. Further, as shown in FIGS. 2 and 4, the Kammback feature 23 may extend into the toe 22 and/or into the heel 24.

Generally, Kammback features are designed to take into account that a laminar flow, which could be maintained with a very long, gradually tapering, downstream (or trailing) end of an aerodynamically-shaped body, cannot be maintained with a shorter, tapered, downstream end. When a downstream tapered end would be too short to maintain a laminar flow, drag due to turbulence may start to become significant after the downstream end of a club head's cross-sectional area is reduced to approximately fifty percent of the club head's maximum cross section. This drag may be mitigated by shearing off or removing the too-short tapered downstream end of the club head, rather than maintaining the too-short tapered end. It is this relatively abrupt cut off of the tapered end that is referred to as the Kammback feature 23.

During a significant portion of the golfer's downswing, as discussed above, the heel 24 and/or the hosel region 26 lead the swing. During these portions of the downswing, either the toe 20, portion of the toe 20, the intersection of the toe 20 with the back 22, and/or portions of the back 22 form the downstream or trailing end of the club head 14 (see, e.g., FIGS. 27 and 29-31). Thus, the Kammback feature 23, when positioned along the toe, at the intersection of the toe 20 with the back 22, and/or along the back 22 of the club head 14, may be expected to reduce turbulent flow, and therefore reduce drag due to turbulence, during these portions of the downswing.

Further, during the last approximately 20° of the golfer's downswing prior to impact with the golf ball, as the ball striking face 17 begins to lead the swing, the back 22 of the club head 14 becomes aligned with the downstream direction of the airflow. Thus, the Kammback feature 23, when positioned along the back 22 of club head 14, is expected to reduce turbulent flow, and therefore reduce drag due to turbulence, most significantly during the last approximately 20° of the golfer's downswing.

According to certain aspects, the Kammback feature 23 may include a continuous groove 29 formed about a portion of a periphery of club head 14. As illustrated in FIGS. 2-4, groove 29 extends from a front portion 30 of toe 20 completely to a rear edge 32 of toe 20, and continues on to rear portion 22. Groove 29 then extends across the entire length of back 22. As can be seen in FIG. 4, groove 29 tapers to an end in a rear portion 34 of heel 24. In certain embodiments (see FIG. 2), groove 29 at front portion 30 of toe 20 may turn and continue along a portion of sole 28.

In the illustrated embodiment of FIGS. 2-4, groove 29 is substantially U-shaped. In certain embodiments, groove 29 has a maximum depth (D) of approximately 15 mm. It is to be appreciated however, that groove 29 may have any depth along its length, and further that the depth of groove 29 may vary along its length. Even further, it is to be appreciated that groove 29 may have any height (H), although a height of from one-quarter to one-half of the maximum sole-to-crown height of the club head 14 may be most advantageous. The height of the groove 29 may vary over its length, as shown in FIGS. 2-4, or alternatively, the height of the groove 29 may be uniform over some or all of its length.

As air flows over crown 18 and sole 28 of body member 15 of club head 14, it tends to separate, which causes increased drag. Groove 29 may serve to reduce the tendency of the air to separate, thereby reducing drag and improving the aerodynamics of club head 14, which in turn increases club head speed and the distance that the ball will travel after being struck. Having groove 29 extend along toe 20 may be particularly advantageous, since for the majority of the swing path of golf club head 14, the leading portion of club head 14 is heel 24 with the trailing edge of club head 14 being toe 20, as noted above. Thus, the aerodynamic advantage provided by groove 29 along toe 20 is realized during the majority of the swing path. The portion of groove 29 that extends along the back 22 may provide an aerodynamic advantage at the point of impact of club head 14 with the ball.

An example of the reduction in drag during the swing provided by groove 29 is illustrated in the table below. This table is based on a computer fluid dynamic (CFD) model for the embodiment of club head 14 as shown in FIGS. 1-6. In the table, drag force values are shown for different degrees of yaw throughout the golf swing for both a square head design and for the square head design incorporating the drag-reducing structure of groove 29.

| | Drag Force | | | | | |
|---|---|---|---|---|---|---|
| | Yaw | | | | | |
| | 90° | 70° | 60° | 45° | 20° | 0° |
| Standard | 0 | 3.04 | 3.68 | 8.81 | 8.60 | 8.32 |
| W/Groove | 0 | 1.27 | 1.30 | 3.25 | 3.39 | 4.01 |

From the results of the computer model, it can be seen that at the point of impact, where the yaw angle is 0°, the drag force for the square club head with groove 29 is approximately 48.2% (4.01/8.32) of that of the square club head. However, an integration of the total drag during the entire swing for the square club head provides a total drag work of 544.39, while the total drag work for the square club head with groove 29 is 216.75. Thus the total drag work for the square club head with groove 29 is approximately 39.8% (216.75/544.39) of that of the square club head. Thus, integrating the drag force throughout the swing can produce a very different result than calculating the drag force at the point of impact only.

Figure 9:
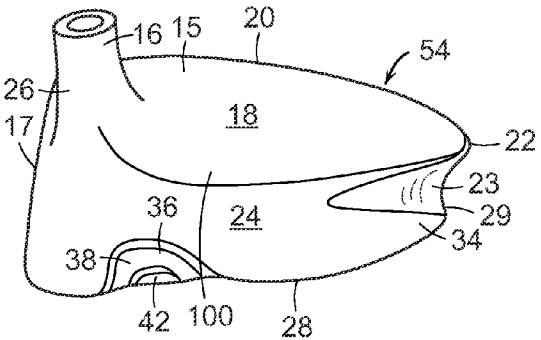
FIG. 9 is a side elevation view of the club head of FIG. 7, viewed from a heel side of the club head.

Referring to FIGS. 7-10, continuous groove 29 is formed about a portion of a periphery of club head 54. As illustrated in FIGS. 7-10, groove 29 extends from a front portion 30 of toe 20 completely to a rear edge 32 of toe 20, and continues on to rear portion 22. Groove 29 then extends across the entire length of rear portion 22. As can be seen in FIG. 9, groove 29 tapers to an end in a rear portion 34 of heel 24.

One or more of the drag-reducing structures, such as the streamlined portion 100 of the heel 24, the diffuser 36 of the sole 28, and/or the Kammback feature 23, may be provided on the club head 14 in order to reduce the drag on the club head during a user's golf swing from the end of a user's backswing throughout the downswing to the ball impact location. Specifically, the streamlined portion 100 of the heel 24, the diffuser 36, and the Kammback feature 23 may be provided to reduce the drag on the club head 14 primarily when the heel 24 and/or the hosel region 26 of the club head 14 are generally leading the swing. The Kammback feature 23, especially when positioned within the back 22 of the club head 14, may also be provided to reduce the drag on the club head 14 when the ball striking face 17 is generally leading the swing.

Different golf clubs are designed for the different skills that a player brings to the game. For example, professional players may opt for clubs that are highly efficient at transforming the energy developed during the swing into the energy driving the golf ball over a very small sweet spot. In contrast, weekend players may opt for clubs designed to forgive less-than-perfect placement of the club's sweet spot relative to the struck golf ball. In order to provide these differing club characteristics, clubs may be provided with club heads having any of various weights, volumes, moments-of-inertias, center-of-gravity placements, stiffnesses, face (i.e., ball-striking surface) heights, widths and/or areas, etc.

Figure 32A:
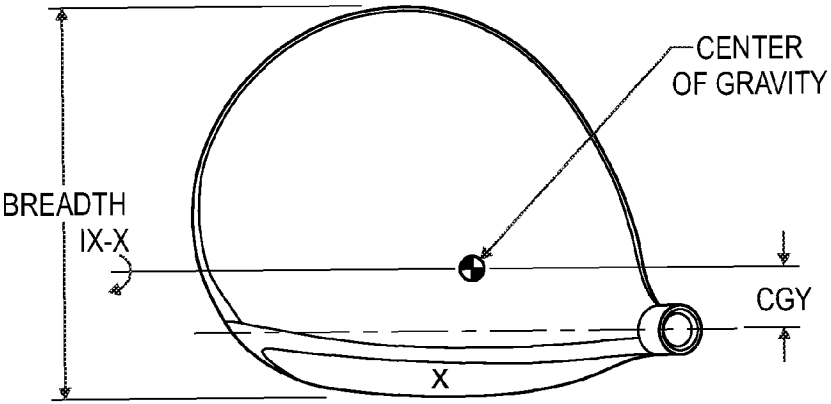
FIGS. 32A and 32B are schematics (top plan view and front elevation) of a club head illustrating certain other physical parameters.
Figure 32B:
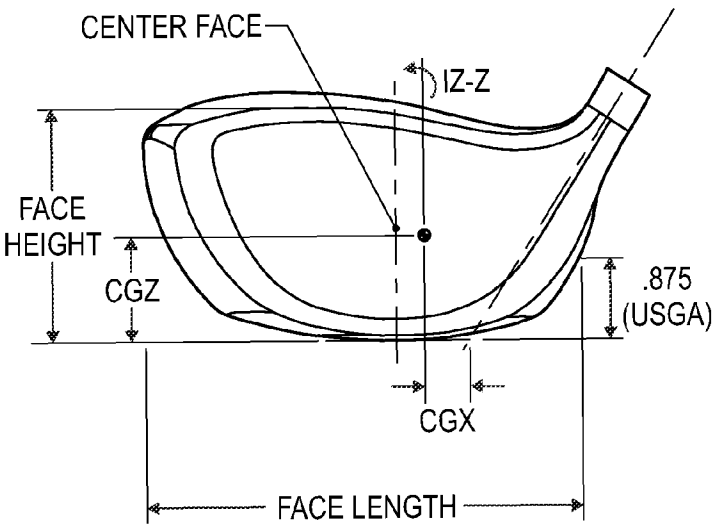

The club heads of typical modern drivers may be provided with a volume that ranges from approximately 420 cc to approximately 470 cc. Club head volumes, as presented herein, are as measured using the USGA "Procedure for Measuring the Club Head Size of Wood Clubs" (Nov. 21, 2003). The club head weight for a typical driver may range from approximately 190 g to approximately 220 g. Referring to FIGS. 32A and 32B, other physical properties of a typical driver can be defined and characterized. For example, the face area may range from approximately 3000 $mm^2$ to approximately 4800 $mm^2$, with a face length that may range from approximately 110 mm to approximately 130 mm and a face height that may range from approximately 48 mm to approximately 62 mm. The face area is defined as the area bounded by the inside tangent of a radius which blends the ball striking face to the other portions of the body member of the golf club head. The face length is measured from opposed points on the club head as shown in FIG. 32B. The face height is defined as the distance measured at the face center (see USGA, "Procedure for Measuring the Flexibility of a Golf ClubHead," Section 6.1 Determination of Impact Location, for determining the location of the face center) from the ground plane to the midpoint of the radius which blends the ball striking face and crown of the club as measured when the club is sitting at a lie angle of 60 degrees with a face angle of zero degrees. The club head breadth may range from approximately 105 mm to approximately 125 mm. The moment-of-inertia at the center-of-gravity around an axis parallel to the $X_0$-axis may range from approximately 2800 g-$cm^2$ to approximately 3200 g-$cm^2$. The moment-of-inertia at the center-of-gravity around an axis parallel to the $Z_0$-axis may range from approximately 4500 g-$cm^2$ to approximately 5500 g-$cm^2$. For typical modern drivers, the location of the center-of-gravity in the $X_0$ direction of the club head (as measured from the ground-zero point) may range from approximately 25 mm to approximately 33 mm; the location of the center-of-gravity in the $Y_0$ direction may also range from approximately 16 mm to approximately 22 mm (also as measured from the ground-zero point); and the location of the center-of-gravity in the $Z_0$ direction may also range from approximately 25 mm to approximately 38 mm (also as measured from the ground-zero point).

The above-presented values for certain characteristic parameters of the club heads of typical modern drivers are not meant to be limiting. Thus, for example, for certain embodiments, club head volumes may exceed 470 cc or club head weights may exceed 220 g. For certain embodiments, the moment-of-inertia at the center-of-gravity around an axis parallel to the $X_0$-axis may exceed 3200 g-$cm^2$. For example, the moment-of-inertia at the center-of-gravity around an axis parallel to the $X_0$-axis may be range up to 3400 g-$cm^2$, up to 3600 g-$cm^2$, or even up to or over 4000 g-$cm^2$. Similarly, for certain embodiments, the moment-of-inertia at the center-of-gravity around an axis parallel to the $Z_0$-axis may exceed 5500 g-$cm^2$. For example, the moment-of-inertia at the center-of-gravity around an axis parallel to the $Z_0$-axis may be range up to 5700 g-$cm^2$, up to 5800 g-$cm^2$, or even up to 6000 g-$cm^2$.

The design of any given golf club always involves a series of tradeoffs or compromises. The following disclosed embodiments illustrate some of these tradeoffs.

Example Embodiment (1)

In a first example, a representative embodiment of a club head as shown in FIGS. 1-6 is described. This first example club head is provided with a volume that is greater than approximately 400 cc. Referring to FIGS. 32A and 32B, other physical properties can be characterized. The face height ranges from approximately 53 mm to approximately 57 mm. The moment-of-inertia at the center-of-gravity around an axis parallel to the $X_0$-axis ranges from approximately 2800 g-cm$^2$ to approximately 3300 g-cm$^2$. The moment-of-inertia at the center-of-gravity around an axis parallel to the $Z_0$-axis is greater than approximately 4800 g-cm$^2$. As an indication of the aspect ratio of the club, the club breadth-to-face length ratio is 0.94 or greater.

In addition, the club head of this first example embodiment may have a weight that ranges from approximately 200 g to approximately 210 g. Referring again to FIGS. 32A and 32B, the face length may range from approximately 114 mm to approximately 118 mm and the face area may range from approximately 3200 mm$^2$ to approximately 3800 mm$^2$. The club head breadth may range from approximately 112 mm to approximately 114 mm. The location of the center-of-gravity in the $X_0$ may range from approximately 28 mm to approximately 32 mm; the location of the center-of-gravity in the $Y_0$ direction may range from approximately 17 mm to approximately 21 mm; and the location of the center-of-gravity in the $Z_0$ direction may range from approximately 27 mm to approximately 31 mm (all as measured from the ground-zero point).

For this example club head, Table I provides a set of nominal spline point coordinates for the upper curve 113 and lower curve 114 of cross-section 110. As discussed, these nominal spline point coordinates may vary, in some instances, within a range of ±10%.

TABLE I

Spline Points for Cross-Section 110 for Example (1)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 113) | 0 | 7 | 11 | 16 | 19 | 22 | 25 | 26 |
| $z_L$-coordinate (mm) (lower surface 114) | 0 | −10 | −14 | −19 | −23 | −25 | −29 | −32 |

Alternatively, for this example club head, the Bézier equations (1a) and (1b) presented above may be used to obtain, respectively, the x- and z-coordinates of the upper curve 113 of cross-section 110 as follows:

$$x_U=3\,(17)\,(1-t)\,t^2+(48)\,t^3 \qquad \text{Equ. (113a)}$$

$$z_U=3\,(10)\,(1-t)^2\,t+3\,(26)\,(1-t)\,t^2+(26)\,t^3 \qquad \text{Equ. (113b)}$$

over the range of: $0 \leqq t \leqq 1$.

Thus, for this particular curve 113, the Bézier control points for the x-coordinates have been defined as: $Pxu_0=0$, $Pxu_1=0$, $Pxu_2=17$ and $Pxu_3=48$, and the Bézier control points for the z-coordinates have been defined as: $Pzu_0=0$, $Pzu_1=10$, $Pzu_2=26$ and $Pzu_3=26$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3\,(11)\,(1-t)\,t^2+(48)\,t^3 \qquad \text{Equ. (114a)}$$

$$z_L=3\,(-10)\,(1-t)^2\,t+3\,(-26)\,(1-t)\,t^2+(-32)\,t^3 \qquad \text{Equ. (114b)}$$

over the range of: $0 \leqq t \leqq 1$.

Thus, for this particular curve 114, the Bézier control points for the x-coordinates have been defined as: $PxL_0=0$, $PxL_1=0$, $PxL_2=11$ and $PxL_3=48$, and the Bézier control points for the z-coordinates have been defined as: $PzL_0=0$, $PzL_1=-10$, $PzL_2=-26$ and $PzL_3=-32$. These z-coordinates may also vary, in some instances, within a range of ±10%.

It can be seen from an examination of the data and the figures that the upper, crown-side curve 113 differs from the lower, sole-side curve 114. For example, at 3 mm along the x-axis from the apex point 112, the lower curve 114 has a z-coordinate value that is approximately 40% greater than the z-coordinate value of the upper curve 113. This introduces an initial asymmetry into the curves, i.e., lower curve 114 starts out deeper than upper curve 113. However, from 3 mm to 24 mm along the x-axis, the upper curve 113 and the lower curve 114 both extend away from the x-axis by an additional 15 mm (i.e., the $\Delta z_U=22-7=15$ mm and the $\Delta z_L=25-10=15$ mm). And, from 3 mm to 36 mm along the x-axis, the upper curve 113 and the lower curve 114 extend away from the x-axis by an additional 18 mm and 19 mm, respectively—a difference of less than 10%. In other words, from 3 mm to 36 mm along the x-axis, the curvatures of the upper curve 113 and the lower curve 114 are approximately the same.

As with curves 113 and 114 discussed above with respect to FIG. 29A, referring now to FIG. 30A, upper and lower curves 123 and 124 for this first example club head each may be characterized by a curve presented as a table of spline points. Table II provides a set of spline point coordinates for the cross-section 120 for Example (1). The $z_U$-coordinates are associated with the upper curve 123; the $z_L$-coordinates are associated with the lower curve 124.

TABLE II

Spline Points for Cross-Section 120 for Example (1)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 123) | 0 | 7 | 11 | 16 | 19 | 21 | 24 | 25 |
| $z_L$-coordinate (mm) (lower surface 124) | 0 | −9 | −13 | −18 | −21 | −24 | −28 | −30 |

Alternatively, for this example club head, the Bézier equations (1a) and (1b) presented above may be used to obtain, respectively, the x- and z-coordinates of the upper curve 123 of cross-section 120 as follows:

$$x_U=3\,(19)\,(1-t)\,t^2+(48)\,t^3 \qquad \text{Equ. (123a)}$$

$$z_U=3\,(10)\,(1-t)^2\,t+3\,(25)\,(1-t)\,t^2+(25)\,t^3 \qquad \text{Equ. (123b)}$$

over the range of: $0 \leqq t \leqq 1$.

Thus, it can be seen that for this particular curve 123, the Bézier control points for the x-coordinates have been defined as: $Pxu_0=0$, $Pxu_1=0$, $Pxu_2=19$ and $Pxu_3=48$, and the Bézier control points for the z-coordinates have been defined as: $Pzu_0=0$, $Pzu_1=10$, $Pzu_2=25$ and $Pzu_3=25$.

As above, for this example club head, the Bézier equations (2a) and (2b) may be used to obtain, respectively, the x- and z-coordinates of the lower curve 124 of cross-section 120 as follows:

$$x_L=3\ (13)\ (1-t)\ t^2+(48)\ t^3 \qquad \text{Equ. (124a)}$$

$$z_L=3\ (-10)\ (1-t)^2\ t+3\ (-26)\ (1-t)\ t^2+(-30)\ t^3 \qquad \text{Equ. (124b)}$$

over the range of: $0 \leqq t \leqq 1$.

Thus, for this particular curve 124, the Bézier control points for the x-coordinates have been defined as: $Pxl_0=0$, $Pxl_1=0$, $Pxl_2=13$ and $Pxl_3=48$, and the Bézier control points for the z-coordinates have been defined as: $Pzl_0=0$, $Pzl_1=-10$, $Pzl_2=-26$ and $Pzl_3=-30$.

It can be seen from an examination of the data and the figures that the upper, crown-side curve 123 differs from the lower, sole-side curve 124. For example, at 3 mm along the x-axis from the apex point 112, the lower curve 124 has a z-coordinate value that is approximately 30% greater than the z-coordinate value of the upper curve 123. This introduces an initial asymmetry into the curves. However, from 3 mm to 18 mm along the x-axis, the upper curve 123 and the lower curve 124 both extend away from the x-axis by an additional 12 mm (i.e., the $\Delta z_U=19-7=12$ mm and the $\Delta z_L=21-9=12$ mm). And, from 3 mm to 24 mm along the x-axis, the upper curve 123 and the lower curve 124 extend away from the x-axis by an additional 14 mm and 15 mm, respectively–a difference of less than 10%. In other words, from 3 mm to 24 mm along the x-axis, the curvatures of the upper curve 123 and the lower curve 124 are approximately the same.

Again, as with surfaces 113 and 114 discussed above, the upper and lower curves 133 and 134 may be characterized by curves presented as a table of spline points. Table III provides a set of spline point coordinates for the cross-section 130 for Example (1). For purposes of this table, all of the coordinates of the spline points are defined relative to the apex point 112. The $z_U$-coordinates are associated with the upper curve 133; the $z_L$-coordinates are associated with the lower curve 134.

TABLE III

Spline Points for Cross-Section 130 for Example (1)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 133) | 0 | 6 | 9 | 12 | 15 | 17 | 18 | 18 |
| $z_L$-coordinate (mm) (lower surface 134) | 0 | −8 | −12 | −16 | −20 | −22 | −26 | −29 |

Alternatively, for this example club head, the Bézier equations (1a) and (1b) presented above may be used to obtain, respectively, the x- and z-coordinates of the upper curve 133 of cross-section 130 as follows:

$$x_U=3\ (25)\ (1-t)\ t^2+(48)\ t^3 \qquad \text{Equ. (133a)}$$

$$z_U=3\ (10)\ (1-t)^2\ t+3\ (21)\ (1-t)\ t^2+(18)\ t^3 \qquad \text{Equ. (133b)}$$

over the range of: $0 \leqq t \leqq 1$.

Thus, for this particular curve 133, the Bézier control points for the x-coordinates have been defined as: $Pxu_0=0$, $Pxu_1=0$, $Pxu_2=25$ and $Pxu_3=48$, and the Bézier control points for the z-coordinates have been defined as: $Pzu_0=0$, $Pzu_1=10$, $Pzu_2=21$ and $Pzu_3=18$.

As above, for this example club head, the Bézier equations (2a) and (2b) may be used to obtain, respectively, the x- and z-coordinates of the lower curve 134 of cross-section 130 as follows:

$$x_L=3\ (12)\ (1-t)\ t^2+(48)\ t^3 \qquad \text{Equ. (134a)}$$

$$z_L=3\ (-10)\ (1-t)^2\ t+3\ (-22)\ (1-t)\ t^2+(-29)\ t^3 \qquad \text{Equ. (124b)}$$

over the range of: $0 \leqq t \leqq 1$.

Thus, for this particular curve 134, the Bézier control points for the x-coordinates have been defined as: $Pxl_0=0$, $Pl_1=0$, $Pxl_2=12$ and $Pxl_3=48$, and the Bézier control points for the z-coordinates have been defined as: $Pzl_0=0$, $Pzl_1=-10$, $Pzl_2=-22$ and $Pzl_3=-29$.

An analysis of the data for this Example (1) embodiment at cross-section 130 shows that at 3 mm along the x-axis from the apex point 112 the lower, sole-side curve 134 has a z-coordinate value that is approximately 30% greater than the z-coordinate value of the upper, crown-side curve 133. This introduces an initial asymmetry into the curves. From 3 mm to 18 mm along the x-axis, the upper curve 133 and the lower curve 134 extend away from the x-axis by an additional 9 mm and 12 mm, respectively. In fact, from 3 mm to 12 mm along the x-axis, the upper curve 133 and the lower curve 134 extend away from the x-axis by an additional 6 mm and 8 mm, respectively—a difference of greater than 10%. In other words, the curvatures of the upper curve 133 and the lower curve 134 for this Example (1) embodiment are significantly different over the range of interest. And it can be seen, by looking at FIG. 31A, that upper curve 133 is flatter (less curved) than lower curve 134.

Further, when the curves of the cross-section 110 (i.e., the cross-section oriented at 90 degrees from the centerline) are compared to the curves of the cross-section 120 (i.e., the cross-section oriented at 70 degrees from the centerline), it can be seen that they are very similar. Specifically, the values of the z-coordinates for the upper curve 113 are the same as the values of the z-coordinates for the upper curve 123 at the x-coordinates of 3 mm, 6 mm, 12 mm and 18 mm, and thereafter, the values for the z-coordinates of the upper curves 113 and 123 depart from each other by less than 10%. With respect to the lower curves 114 and 124 for the cross-sections 110 and 120, respectively, the values of the z-coordinates depart from each other by 10% or less over the x-coordinate range from 0 mm to 48 mm, with the lower curve 124 being slightly smaller than the lower curve 114. When the curves of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by a fairly constant amount—either 2 mm or 3 mm—over the x-coordinate range of 0 mm to 48 mm. On the other hand, it can be seen that the difference in the values of the z-coordinates for the upper curve 133 of the cross-section 130 from the values of the z-coordinates for the upper curve 113 of the cross-section 110 increases over the x-coordinate range of 0 mm to 48 mm. In other words, the curvature of the upper curve 133 significantly departs from curvature of the upper curve 113, with upper curve 133 being significantly flatter than upper curve 113. This can also be appreciated by comparing curve 113 in FIG. 29A with curve 133 in FIG. 31A.

Example Embodiment (2)

In a second example, a representative embodiment of a club head as shown in FIGS. 7-10 is described. This second example club head is provided with a volume that is greater than approximately 400 cc. The face height ranges from approximately 56 mm to approximately 60 mm. The moment-of-inertia at the center-of-gravity around an axis parallel to the $X_0$-axis ranges from approximately 2600 g-cm$^2$ to approximately 3000 g-cm$^2$. The moment-of-inertia at the center-of-gravity around an axis parallel to the $Z_0$-axis ranges from approximately 4500 g-cm$^2$ to approximately 5200 g-cm$^2$. The club breadth-to-face length ratio is 0.90 or greater.

In addition, the club head of this second example embodiment may have a weight that ranges from approximately 197 g to approximately 207 g. Referring again to FIGS. 32A and 32B, the face length may range from approximately 122 mm to approximately 126 mm and the face area may range from approximately 3200 mm$^2$ to approximately 3800 mm$^2$. The club head breadth may range from approximately 112 mm to approximately 116 mm. The location of the center-of-gravity in the $X_0$ direction may range from approximately 28 mm to approximately 32 mm; the location of the center-of-gravity in the $Y_0$ direction may range from approximately 17 mm to approximately 21 mm; and the location of the center-of-gravity in the $Z_0$ direction may range from approximately 33 mm to approximately 37 mm (all as measured from the ground-zero point).

For this Example (2) club head, Table IV provides a set of nominal spline point coordinates for the upper and lower curves of cross-section 110. As previously discussed, these nominal spline point coordinates may vary, in some instances, within a range of ±10%.

TABLE IV

Spline Points for Cross-Section 110 for Example (2)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 113) | 0 | 6 | 9 | 13 | 16 | 19 | 22 | 23 |
| $z_L$-coordinate (mm) (lower surface 114) | 0 | −9 | −13 | −18 | −21 | −24 | −30 | −33 |

Alternatively, for this example club head, the Bézier equations (1a) and (1b) presented above may be used to obtain, respectively, the x- and z-coordinates of the upper curve 113 of cross-section 110 as follows:

$$x_U=3\,(22)\,(1-t)\,t^2+(48)\,t^3 \qquad \text{Equ. (213a)}$$

$$z_U=3\,(8)\,(1-t)^2\,t+3\,(23)\,(1-t)\,t^2+(23)\,t^3 \qquad \text{Equ. (213b)}$$

over the range of: $0 \leqq t \leqq 1$.

Thus, for this particular curve 113, the Bézier control points for the x-coordinates have been defined as: $Pxu_0=0$, $Pxu_1=0$, $Pxu_2=22$ and $Pxu_3=48$, and the Bézier control points for the z-coordinates have been defined as: $Pzu_0=0$, $Pzu_1=8$, $Pzu_2=23$ and $Pzu_3=23$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3\,(18)\,(1-t)\,t^2+(48)\,t^3 \qquad \text{Equ. (214a)}$$

$$z_L=3\,(-12)\,(1-t)^2\,t+3\,(-25)\,(1-t)\,t^2+(-33)\,t^3 \qquad \text{Equ. (214b)}$$

over the range of: $0 \leqq t \leqq 1$.

Thus, for this particular curve 114, the Bézier control points for the x-coordinates have been defined as: $PxL_0=0$, $PxL_1=0$, $PxL_2=18$ and $PxL_3=48$, and the Bézier control points for the z-coordinates have been defined as: $PzL_0=0$, $PzL_1=-12$, $PzL_2=-25$ and $PzL_3=-33$. These z-coordinates may also vary, in some instances, within a range of ±10%.

It can be seen from an examination of the data of this Example (2) embodiment at cross-section 110 that at 3 mm along the x-axis from the apex point 112, the lower curve 114 has a z-coordinate value that is 50% greater than the z-coordinate value of the upper curve 113. This introduces an initial asymmetry into the curves. However, from 3 mm to 24 mm along the x-axis, the upper curve 113 extends away from the x-axis by an additional 13 mm (i.e., $\Delta z_U=19-6=13$ mm) and the lower curve 114 extends away from the x-axis by an additional 15 mm (i.e., $\Delta z_L=24-9=15$ mm). And, from 3 mm to 36 mm along the x-axis, the upper curve 113 and the lower curve 114 extend away from the x-axis by an additional 16 mm and 21 mm, respectively. In other words, from 3 mm to 36 mm along the x-axis, the upper curve 113 is flatter than the lower curve 114.

As with curves 113 and 114 discussed above with respect to FIG. 29A, referring now to FIG. 30A, upper and lower curves 123 and 124 for this second example club head may be characterized by a curve presented as a table of spline points. Table V provides a set of spline point coordinates for the cross-section 120 for Example (2). For purposes of this table, the coordinates of the spline points are defined as values relative to the apex point 112. The $z_U$-coordinates are associated with the upper curve 123; the $z_L$-coordinates are associated with the lower curve 124.

TABLE V

Spline Points for Cross-Section 120 for Example (2)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 123) | 0 | 6 | 8 | 12 | 15 | 17 | 20 | 21 |
| $z_L$-coordinate (mm) (lower surface 124) | 0 | −9 | −12 | −17 | −21 | −24 | −29 | −33 |

Alternatively, for this example club head, the Bézier equations (1a) and (1b) presented above may be used to obtain, respectively, the x- and z-coordinates of the upper curve 123 of cross-section 120 as follows:

$$x_U=3\,(28)\,(1-t)\,t^2+(48)\,t^3 \qquad \text{Equ. (223a)}$$

$$z_U=3\,(9)\,(1-t)^2\,t+3\,(22)\,(1-t)\,t^2+(21)\,t^3 \qquad \text{Equ. (223b)}$$

over the range of: $0 \leqq t \leqq 1$.

Thus, it can be sent that for this particular curve 123, the Bézier control points for the x-coordinates have been defined as: $Pxu_0=0$, $Pxu_1=0$, $Pxu_2=28$ and $Pxu_3=48$, and the Bézier control points for the z-coordinates have been defined as: $Pzu_0=0$, $Pzu_1=9$, $Pzu_2=22$ and $Pzu_3=21$.

As above, for this example club head, the Bézier equations (2a) and (2b) may be used to obtain, respectively, the x- and z-coordinates of the lower curve 124 of cross-section 120 as follows:

$$x_L=3\,(13)\,(1-t)\,t^2+(48)\,t^3 \qquad \text{Equ. (224a)}$$

$$z_L=3\,(-11)\,(1-t)^2\,t+3\,(-22)\,(1-t)\,t^2+(-33)\,t^3 \qquad \text{Equ. (124b)}$$

over the range of: $0 \leqq t \leqq 1$.

Thus, for this particular curve 124, the Bézier control points for the x-coordinates have been defined as: $PxL_0=0$, $PxL_1=0$, $PxL_2=13$ and $PxL_3=48$, and the Bézier control points for the z-coordinates have been defined as: $PzL_0=0$, $PzL_1=-11$, $PzL_2=-22$ and $PzL_3=-33$.

At cross-section 120 at 3 mm along the x-axis from the apex point 112, the lower curve 124 has a z-coordinate value that is 50% greater than the z-coordinate value of the upper curve 123. This introduces an initial asymmetry into the curves. However, from 3 mm to 24 mm along the x-axis, the upper curve 123 extends away from the x-axis by an additional 11 mm (i.e., $\Delta z_U$=17−6=11 mm) and the lower curve 124 extends away from the x-axis by an additional 15 mm (i.e., $\Delta z_L$=24−9=15 mm). And, from 3 mm to 36 mm along the x-axis, the upper curve 123 and the lower curve 124 extend away from the x-axis by an additional 14 mm and 20 mm, respectively. In other words, similar to the curves of cross-section 110, from 3 mm to 36 mm along the x-axis, the upper curve 123 is flatter than the lower curve 124.

As with surfaces 113 and 114 discussed above, the upper and lower curves 133 and 134 may be characterized by curves presented as a table of spline points. Table VI provides a set of spline point coordinates for the cross-section 130 for Example (2). For purposes of this table, all of the coordinates of the spline points are defined relative to the apex point 112. The $z_U$-coordinates are associated with the upper curve 133; the $z_L$-coordinates are associated with the lower curve 134.

TABLE VI

Spline Points for Cross-Section 130 for Example (2)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 133) | 0 | 5 | 7 | 9 | 10 | 12 | 13 | 13 |
| $z_L$-coordinate (mm) (lower surface 134) | 0 | −6 | −10 | −15 | −18 | −21 | −26 | −30 |

Alternatively, for this example club head, the Bézier equations (1a) and (1b) presented above may be used to obtain, respectively, the x- and z-coordinates of the upper curve 133 of cross-section 130 as follows:

$$x_U=3\,(26)\,(1-t)\,t^2+(48)\,t^3 \qquad \text{Equ. (233a)}$$

$$z_U=3\,(9)\,(1-t)^2\,t+3\,(14)\,(1-t)\,t^2+(13)\,t^3 \qquad \text{Equ. (233b)}$$

over the range of: $0 \leqq t \leqq 1$.

Thus, for this particular curve 133, the Bézier control points for the x-coordinates have been defined as: $Pxu_0=0$, $Pxu_1=0$, $Pxu_2=26$ and $Pxu_3=48$, and the Bézier control points for the z-coordinates have been defined as: $Pzu_0=0$, $Pzu_1=9$, $Pzu_2=14$ and $Pzu_3=13$.

As above, for this example club head, the Bézier equations (2a) and (2b) may be used to obtain, respectively, the x- and z-coordinates of the lower curve 134 of cross-section 130 as follows:

$$x_L=3\,(18)\,(1-t)\,t^2+(48)\,t^3 \qquad \text{Equ. (234a)}$$

$$z_L=3\,(-7)\,(1-t)^2\,t+3\,(-23)\,(1-t)\,t^2+(-30)\,t^3 \qquad \text{Equ. (234b)}$$

over the range of: $0 \leqq t \leqq 1$.

Thus, for this particular curve 134, the Bézier control points for the x-coordinates have been defined as: $PxL_0=0$, $PxL_1=0$, $PxL_2=18$ and $PxL_3=48$, and the Bézier control points for the z-coordinates have been defined as: $PzL_0=0$, $PzL_1=-7$, $PzL_2=-23$ and $PzL_3=-30$.

At cross-section 130, at 3 mm along the x-axis from the apex point 112, the lower curve 134 has a z-coordinate value that is only 20% greater than the z-coordinate value of the upper curve 133. This introduces an initial asymmetry into the curves. From 3 mm to 24 mm along the x-axis, the upper curve 133 extends away from the x-axis by an additional 7 mm (i.e., $\Delta z_U$=12−5=7 mm) and the lower curve 134 extends away from the x-axis by an additional 15 mm (i.e., $\Delta z_L$=21−6=15 mm). And, from 3 mm to 36 mm along the x-axis, the upper curve 133 and the lower curve 134 extend away from the x-axis by an additional 8 mm and 20 mm, respectively. In other words, from 3 mm to 36 mm along the x-axis, the upper curve 133 is significantly flatter than the lower curve 134.

Further, for this Example (2) embodiment, when the curves of the cross-section 110 (i.e., the cross-section oriented at 90 degrees from the centerline) are compared to the curves of the cross-section 120 (i.e., the cross-section oriented at 70 degrees from the centerline), it can be seen that they are similar. Specifically, the values of the z-coordinates for the upper curve 113 vary from the values of the z-coordinates for the upper curve 123 by approximately 10% or less. With respect to the lower curves 114 and 124 for the cross-sections 110 and 120, respectively, the values of the z-coordinates depart from each other by less than 10% over the x-coordinate range from 0 mm to 48 mm, with the lower curve 124 being slightly smaller than the lower curve 114. When the curves for this Example (2) embodiment of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by a fairly constant amount—either 3 mm or 4 mm—over the x-coordinate range of 0 mm to 48 mm. On the other hand, it can be seen that the difference in the values of the z-coordinates for the upper curve 133 of the cross-section 130 from the values of the z-coordinates for the upper curve 113 of the cross-section 110 steadily increases over the x-coordinate range of 0 mm to 48 mm. In other words, the curvature of the upper curve 133 significantly departs from curvature of the upper curve 113, with upper curve 133 being significantly flatter than upper curve 113.

Example Embodiment (3)

In a third example, a representative embodiment of a club head as shown in FIGS. 15-20 is described. This third example club head is provided with a volume that is greater than approximately 400 cc. The face height ranges from approximately 52 mm to approximately 56 mm. The moment-of-inertia at the center-of-gravity around an axis parallel to the $X_0$-axis ranges from approximately 2900 g-cm$^2$ to approximately 3600 g-cm$^2$. The moment-of-inertia at the center-of-gravity around an axis parallel to the $Z_0$-axis is greater than approximately 5000 g-cm$^2$. The club breadth-to-face length ratio is 0.94 or greater.

This third example club head may also be provided with a weight that may range from approximately 200 g to approximately 210 g. Referring to FIGS. 32A and 32B, a face length may range from approximately 122 mm to approximately 126 mm and a face area may range from approximately 3300 mm$^2$ to approximately 3900 mm$^2$. The club head breadth may range from approximately 115 mm to approximately 118 mm. The location of the center-of-gravity in the $X_0$ direction may range from approximately 28 mm to approximately 32 mm; the location of the center-of-gravity in the $Y_0$ direction may range from approximately 16 mm to approximately 20 mm; and the location of the center-of-gravity in the $Z_0$ direction may range from approximately 29 mm to approximately 33 mm (all as measured from the ground-zero point).

For this Example (3) club head, Table VII provides a set of nominal spline point coordinates for the upper and lower curves of cross-section 110. As previously discussed, these nominal spline point coordinates may vary, in some instances, within a range of ±10%.

TABLE VII

Spline Points for Cross-Section 110 for Example (3)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 113) | 0 | 4 | 6 | 7 | 9 | 10 | 11 | 11 |
| $z_L$-coordinate (mm) (lower surface 114) | 0 | −15 | −20 | −26 | −31 | −34 | −40 | −44 |

Alternatively, for this example club head, the Bézier equations (1a) and (1b) presented above may be used to obtain, respectively, the x- and z-coordinates of the upper curve 113 of cross-section 110 as follows:

$$x_U=3\,(17)\,(1-t)\,t^2+(48)\,t^3 \qquad \text{Equ. (313a)}$$

$$z_U=3\,(5)\,(1-t)^2\,t+3\,(12)\,(1-t)\,t^2+(11)\,t^3 \qquad \text{Equ. (313b)}$$

over the range of: $0 \leqq t \leqq 1$.

Thus, for this particular curve 113, the Bézier control points for the x-coordinates have been defined as: $Pxu_0=0$, $Pxu_1=0$, $Pxu_2=17$ and $Pxu_3=48$, and the Bézier control points for the z-coordinates have been defined as: $Pzu_0=0$, $Pzu_1=5$, $Pzu_2=12$ and $Pzu_3=11$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3\,(7)\,(1-t)\,t^2+(48)\,t^3 \qquad \text{Equ. (314a)}$$

$$z_L=3\,(-15)\,(1-t)^2\,t+3\,(-32)\,(1-t)\,t^2+(-44)\,t^3 \qquad \text{Equ. (314b)}$$

over the range of: $0 \leqq t \leqq 1$.

Thus, for this particular curve 114, the Bézier control points for the x-coordinates have been defined as: $PxL_0=0$, $PxL_1=0$, $PxL_2=7$ and $PxL_3=48$, and the Bézier control points for the z-coordinates have been defined as: $PzL_0=0$, $PzL_1=-15$, $PzL_2=-32$ and $PzL_3=-44$. These z-coordinates may also vary, in some instances, within a range of ±10%.

It can be seen from an examination of the data of this Example (3) embodiment at cross-section 110 that at 3 mm along the x-axis from the apex point 112, the lower curve 114 has a z-coordinate value that is 275% greater than the z-coordinate value of the upper curve 113. This introduces an initial asymmetry into the curves. From 3 mm to 24 mm along the x-axis, the upper curve 113 extends away from the x-axis by an additional 6 mm (i.e., $\Delta z_U=10-4=6$ mm) and the lower curve 114 extends away from the x-axis by an additional 19 mm (i.e., $\Delta z_L=34-15=19$ mm). And, from 3 mm to 36 mm along the x-axis, the upper curve 113 and the lower curve 114 extend away from the x-axis by an additional 7 mm and 25 mm, respectively. In other words, from 3 mm to 36 mm along the x-axis, the upper curve 113 is significantly flatter than the lower curve 114.

As with curves 113 and 114 discussed above with respect to FIG. 29A, referring now to FIG. 30A, upper and lower curves 123 and 124 for this third example club head may be characterized by a curve presented as a table of spline points. Table VIII provides a set of spline point coordinates for the cross-section 120 for Example (3). For purposes of this table, the coordinates of the spline points are defined as values relative to the apex point 112. The $z_U$-coordinates are associated with the upper curve 123; the $z_L$-coordinates are associated with the lower curve 124.

TABLE VIII

Spline Points for Cross-Section 120 for Example (3)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 123) | 0 | 4 | 4 | 5 | 6 | 7 | 7 | 7 |
| $z_L$-coordinate (mm) (lower surface 124) | 0 | −14 | −19 | −26 | −30 | −34 | −39 | −43 |

Alternatively, for this Example (3) club head, the Bézier equations (1a) and (1b) presented above may be used to obtain, respectively, the x- and z-coordinates of the upper curve 123 of cross-section 120 as follows:

$$x_U=3\,(21)\,(1-t)\,t^2+(48)\,t^3 \qquad \text{Equ. (323a)}$$

$$z_U=3\,(5)\,(1-t)^2\,t+3\,(7)\,(1-t)\,t^2+(7)\,t^3 \qquad \text{Equ. (323b)}$$

over the range of: $0 \leqq t \leqq 1$.

Thus, it can be seen that for this particular curve 123, the Bézier control points for the x-coordinates have been defined as: $Pxu_0=0$, $Pxu_1=0$, $Pxu_2=21$ and $Pxu_3=48$, Bézier control points for the z-coordinates have been defined as: $Pzu_0=0$, $Pzu_1=5$, $Pzu_2=7$ and $Pzu_3=7$.

As above, for this example club head, the Bézier equations (2a) and (2b) may be used to obtain, respectively, the x- and z-coordinates of the lower curve 124 of cross-section 120 as follows:

$$x_L=3\,(13)\,(1-t)\,t^2+(48)\,t^3 \qquad \text{Equ. (324a)}$$

$$z_L=3\,(-18)\,(1-t)^2\,t+3\,(-34)\,(1-t)\,t^2+(-43)\,t^3 \qquad \text{Equ. (124b)}$$

over the range of: $0 \leqq t \leqq 1$.

Thus, for this particular curve 124, the Bézier control points for the x-coordinates have been defined as: $PxL_0=0$, $PxL_1=0$, $PxL_2=13$ and $PxL_3=48$, and the Bézier control points for the z-coordinates have been defined as: $PzL_0=0$, $PzL_1=-18$, $PzL_2=-34$ and $PzL_3=-43$.

At cross-section 120 for Example (3) at 3 mm along the x-axis from the apex point 112, the lower curve 124 has a z-coordinate value that is 250% greater than the z-coordinate value of the upper curve 123. This introduces an initial asymmetry into the curves. From 3 mm to 24 mm along the x-axis, the upper curve 123 extends away from the x-axis by an additional 3 mm (i.e., $\Delta z_U=7-4=3$ mm) and the lower curve 124 extends away from the x-axis by an additional 20 mm (i.e., $\Delta z_L=34-14=20$ mm). And, from 3 mm to 36 mm along the x-axis, the upper curve 123 and the lower curve 124 extend away from the x-axis by an additional 3 mm and 25 mm, respectively. In other words, similar to the curves of cross-section 110, from 3 mm to 36 mm along the x-axis, the upper curve 123 is significantly flatter than the lower curve 124. In fact, from 24 mm to 48 mm, the upper curve 123 maintains a constant distance from the x-axis, while the lower curve 124 over this same range departs by an additional 9 mm.

As with surfaces 113 and 114 discussed above, the upper and lower curves 133 and 134 may be characterized by curves presented as a table of spline points. Table IX provides a set of spline point coordinates for the cross-section 130 for Example (3). For purposes of this table, all of the coordinates of the spline points are defined relative to the apex point 112. The $z_U$-coordinates are associated with the upper curve 133; the $z_L$-coordinates are associated with the lower curve 134.

TABLE IX

Spline Points for Cross-Section 130 for Example (3)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 133) | 0 | 4 | 3 | 3 | 2 | 2 | 0 | −2 |
| $z_L$-coordinate (mm) (lower surface 134) | 0 | −11 | −16 | −22 | −27 | −30 | −37 | −41 |

Alternatively, for this example club head, the Bézier equations (1a) and (1b) presented above may be used to obtain, respectively, the x- and z-coordinates of the upper curve 133 of cross-section 130 as follows:

$$x_U=3\ (5)\ (1-t)\ t^2+(48)\ t^3 \qquad \text{Equ. (333a)}$$

$$z_U=3\ (6)\ (1-t)^2\ t+3\ (5)\ (1-t)\ t^2+(-2)\ t^3 \qquad \text{Equ. (333b)}$$

over the range of: $0 \leqq t \leqq 1$.

Thus, for this particular curve 133, the Bézier control points for the x-coordinates have been defined as: $Pxu_0=0$, $Pxu_1=0$, $Pxu_2=5$ and $Pxu_3=48$, and the Bézier control points for the z-coordinates have been defined as: $Pzu_0=0$, $Pzu_1=6$, $Pzu_2=5$ and $Pzu_3=-2$.

As above, for this Example (3) club head, the Bézier equations (2a) and (2b) may be used to obtain, respectively, the x- and z-coordinates of the lower curve 134 of cross-section 130 as follows:

$$x_L=3\ (18)\ (1-t)\ t^2+(48)\ t^3 \qquad \text{Equ. (334a)}$$

$$z_L=3\ (-15)\ (1-t)^2\ t+3\ (-32)\ (1-t)\ t^2+(-41)\ t^3 \qquad \text{Equ. (334b)}$$

over the range of: $0 \leqq t \leqq 1$.

Thus, for this particular curve 134, the Bézier control points for the x-coordinates have been defined as: $PxL_0=0$, $PxL_1=0$, $PxL_2=18$ and $PxL_3=48$, and the Bézier control points for the z-coordinates have been defined as: $PzL_0=0$, $PzL_1=-15$, $PzL_2=-32$ and $PzL_3=-41$.

At cross-section 130 for Example (3), at 3 mm along the x-axis from the apex point 112, the lower curve 134 has a z-coordinate value that is 175% greater than the z-coordinate value of the upper curve 133. This introduces an initial asymmetry into the curves. From 3 mm to 24 mm along the x-axis, the upper curve 133 extends away from the x-axis by −2 mm (i.e., $\Delta z_U=2-4=-2$ mm). In other words, the upper curve 133 has actually approached the x-axis over this range. On the other hand, the lower curve 134 extends away from the x-axis by an additional 19 mm (i.e., $\Delta z_L=30-11=19$ mm). And, from 3 mm to 36 mm along the x-axis, the upper curve 133 and the lower curve 134 extend away from the x-axis by an additional −4 mm and 26 mm, respectively. In other words, from 3 mm to 36 mm along the x-axis, the upper curve 133 is significantly flatter than the lower curve 134.

Further, for this Example (3) embodiment, when the curves of the cross-section 110 (i.e., the cross-section oriented at 90 degrees from the centerline) are compared to the curves of the cross-section 120 (i.e., the cross-section oriented at 70 degrees from the centerline), it can be seen that the upper curves vary significantly, while the lower curves are very similar. Specifically, the values of the z-coordinates for the upper curve 113 vary from the values of the z-coordinates for the upper curve 123 by up to 57% (relative to upper curve 123). Upper curve 123 is significantly flatter than upper curve 113. With respect to the lower curves 114 and 124 for the cross-sections 110 and 120, respectively, the values of the z-coordinates depart from each other by less than 10% over the x-coordinate range from 0 mm to 48 mm, with the lower curve 124 being slightly smaller than the lower curve 114. When the curves for this Example (3) embodiment of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by a fairly constant amount—either 3 mm or 4 mm—over the x-coordinate range of 0 mm to 48 mm. Thus, the curvature of lower curve 134 is approximately the same as the curvature of lower curve 114, with respect to the x-axis, over the x-coordinate range of 0 mm to 48 mm. On the other hand, it can be seen that the difference in the values of the z-coordinates for the upper curve 133 of the cross-section 130 from the values of the z-coordinates for the upper curve 113 of the cross-section 110 steadily increases over the x-coordinate range of 0 mm to 48 mm. In other words, the curvature of the upper curve 133 significantly departs from curvature of the upper curve 113, with upper curve 133 being significantly flatter than upper curve 113.

Example Embodiment (4)

In a fourth example, a representative embodiment of a club head as shown in FIGS. 21-26 is described. This fourth example club head is provided with a volume that is greater than approximately 400 cc. The face height ranges from approximately 58 mm to approximately 63 mm. The moment-of-inertia at the center-of-gravity around an axis parallel to the $X_0$-axis ranges from approximately 2800 g-cm$^2$ to approximately 3300 g-cm$^2$. The moment-of-inertia at the center-of-gravity around an axis parallel to the $Z_0$-axis ranges from approximately 4500 g-cm$^2$ to approximately 5200 g-cm$^2$. The club breadth-to-face length ratio is 0.94 or greater.

Additionally, this fourth example club head is provided with a weight that may range from approximately 200 g to approximately 210 g. Referring to FIGS. 32A and 32B, the face length that may range from approximately 118 mm to approximately 122 mm and the face area may range from approximately 3900 mm$^2$ to 4500 mm$^2$. The club head breadth may range from approximately 116 mm to approximately 118 mm. The location of the center-of-gravity in the $X_0$ direction may range from approximately 28 mm to approximately 32 mm; the location of the center-of-gravity in the $Y_0$ direction may range from approximately 15 mm to approximately 19 mm; and the location of the center-of-gravity in the $Z_0$ direction may range from approximately 29 mm to approximately 33 mm (all as measured from the ground-zero point).

For this Example (4) club head, Table X provides a set of nominal spline point coordinates for the heel side of cross-section 110. These spline point coordinates are provided as absolute values. As discussed, these nominal spline point coordinates may vary, in some instances, within a range of ±10%.

TABLE X

Spline Points for Cross-Section 110 for Example (4)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 113) | 0 | 5 | 7 | 11 | 14 | 16 | 19 | 20 |
| $z_L$-coordinate (mm) (lower surface 114) | 0 | −10 | −14 | −21 | −26 | −30 | −36 | −40 |

Alternatively, for this Example (4) club head, the Bézier equations (1a) and (1b) presented above may be used to obtain, respectively, the x- and z-coordinates of the upper curve 113 of cross-section 110 as follows:

$$x_U=3\,(31)\,(1-t)\,t^2+(48)\,t^3 \qquad \text{Equ. (413a)}$$

$$z_U=3\,(9)\,(1-t)^2\,t+3\,(21)\,(1-t)\,t^2+(20)\,t^3 \qquad \text{Equ. (413b)}$$

over the range of: $0 \leqq t \leqq 1$.

Thus, for this particular curve 113, the Bézier control points for the x-coordinates have been defined as: $Pxu_0=0$, $Pxu_1=0$, $Pxu_2=31$ and $Pxu_3=48$, and the Bézier control points for the z-coordinates have been defined as: $Pzu_0=0$, $Pzu_1=9$, $Pzu_2=21$ and $Pzu_3=20$. As discussed, these z-coordinates may vary, in some instances, within a range of ±10%.

Similarly, for this example club head, the Bézier equations (2a) and (2b) may be used to obtain, respectively, the x- and z-coordinates of the lower curve 114 of cross-section 110 as follows:

$$x_L=3\,(30)\,(1-t)\,t^2+(48)\,t^3 \qquad \text{Equ. (414a)}$$

$$z_L=3\,(-17)\,(1-t)^2\,t+3\,(-37)\,(1-t)\,t^2+(-40)\,t^3 \qquad \text{Equ. (414b)}$$

over the range of: $0 \leqq t \leqq 1$.

Thus, for this particular curve 114, the Bézier control points for the x-coordinates have been defined as: $PxL_0=0$, $PxL_1=0$, $PxL_2=30$ and $PxL_3=48$, and the Bézier control points for the z-coordinates have been defined as: $PzL_0=0$, $PzL_1=-17$, $PzL_2=-37$ and $PzL_3=-40$. These z-coordinates may also vary, in some instances, within a range of ±10%.

It can be seen from an examination of the data of this Example (4) embodiment at cross-section 110 that at 3 mm along the x-axis from the apex point 112, the lower curve 114 has a z-coordinate value that is 100% greater than the z-coordinate value of the upper curve 113. This introduces an initial asymmetry into the curves. From 3 mm to 24 mm along the x-axis, the upper curve 113 extends away from the x-axis by an additional 11 mm (i.e., $\Delta z_U=16-5=11$ mm) and the lower curve 114 extends away from the x-axis by an additional 20 mm (i.e., $\Delta z_L=30-10=20$ mm). And, from 3 mm to 36 mm along the x-axis, the upper curve 113 and the lower curve 114 extend away from the x-axis by an additional 14 mm and 26 mm, respectively. In other words, from 3 mm to 36 mm along the x-axis, the upper curve 113 is significantly flatter than the lower curve 114.

As with curves 113 and 114 discussed above with respect to FIG. 29A, referring now to FIG. 30A, upper and lower curves 123 and 124 for this first example club head may be characterized by a curve presented as a table of spline points. Table XI provides a set of spline point coordinates for the cross-section 120 for Example (4). For purposes of this table, the coordinates of the spline points are defined relative to the apex point 112. The $z_U$-coordinates are associated with the upper curve 123; the $z_L$-coordinates are associated with the lower curve 124.

TABLE XI

Spline Points for Cross-Section 120 Example (4)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 123) | 0 | 4 | 5 | 8 | 10 | 12 | 14 | 14 |
| $z_L$-coordinate (mm) (lower surface 124) | 0 | −11 | −15 | −22 | −27 | −31 | −37 | −41 |

Alternatively, for this Example (4) club head, the Bézier equations (1a) and (1b) presented above may be used to obtain, respectively, the x- and z-coordinates of the upper curve 123 of cross-section 120 as follows:

$$x_U=3\,(25)\,(1-t)\,t^2+(48)\,t^3 \qquad \text{Equ. (423a)}$$

$$z_U=3\,(4)\,(1-t)^2\,t+3\,(16)\,(1-t)\,t^2+(14)\,t^3 \qquad \text{Equ. (124b)}$$

over the range of: $0 \leqq t \leqq 1$.

Thus, it can be seen that for this particular curve 123, the Bézier control points for the x-coordinates have been defined as: $Pxu_0=0$, $Pxu_1=0$, $Pxu_2=25$ and $Pxu_3=48$, Bézier control points for the z-coordinates have been defined as: $Pzu_0=0$, $Pzu_1=4$, $Pzu_2=16$ and $Pzu_3=14$.

As above, for this example club head, the Bézier equations (2a) and (2b) may be used to obtain, respectively, the x- and z-coordinates of the lower curve 124 of cross-section 120 as follows:

$$x_L=3\,(26)\,(1-t)\,t^2+(48)\,t^3 \qquad \text{Equ. (424a)}$$

$$z_L=3\,(-18)\,(1-t)^2\,t+3\,(-36)\,(1-t)\,t^2+(-41)\,t^3 \qquad \text{Equ. (124b)}$$

over the range of: $0 \leqq t \leqq 1$.

Thus, for this particular curve 124, the Bézier control points for the x-coordinates have been defined as: $PxL_0=0$, $PzL_1=0$, $PxL_2=26$ and $PxL_3=48$, and the Bézier control points for the z-coordinates have been defined as: $PzL_0=0$, $PzL_1=-18$, $PzL_2=-36$ and $P_{ZL3}=-41$.

At cross-section 120 for Example (4) at 3 mm along the x-axis from the apex point 112, the lower curve 124 has a z-coordinate value that is 175% greater than the z-coordinate value of the upper curve 123. This introduces an initial asymmetry into the curves. From 3 mm to 24 mm along the x-axis, the upper curve 123 extends away from the x-axis by an additional 8 mm (i.e., $\Delta z_U=12-4=8$ mm) and the lower curve 124 extends away from the x-axis by an additional 20 mm (i.e., $\Delta z_L=31-11=20$ mm). And, from 3 mm to 36 mm along the x-axis, the upper curve 123 and the lower curve 124 extend away from the x-axis by an additional 10 mm and 26 mm, respectively. In other words, similar to the curves of cross-section 110, from 3 mm to 36 mm along the x-axis, the upper curve 123 is significantly flatter than the lower curve 124.

As with surfaces 113 and 114 discussed above, the upper and lower curves 133 and 134 may be characterized by curves presented as a table of spline points. Table XII provides a set of spline point coordinates for the cross-section 130 for Example (4). For purposes of this table, all of the coordinates of the spline points are defined relative to the apex point 112. The $z_U$-coordinates are associated with the upper curve 133; the $z_L$-coordinates are associated with the lower curve 134.

TABLE XII

Spline Points for Cross-Section 130 for Example (4)

| | x-coordinate (mm) | | | | | | | |
|---|---|---|---|---|---|---|---|---|
| | 0 | 3 | 6 | 12 | 18 | 24 | 36 | 48 |
| $z_U$-coordinate (mm) (upper surface 133) | 0 | 4 | 4 | 5 | 6 | 7 | 7 | 5 |
| $z_L$-coordinate (mm) (lower surface 134) | 0 | −8 | −12 | −18 | −22 | −26 | −32 | −37 |

Alternatively, for this example club head, the Bézier equations (1a) and (1b) presented above may be used to obtain, respectively, the x- and z-coordinates of the upper curve 133 of cross-section 130 as follows:

$$x_U=3\,(35)\,(1-t)\,t^2+(48)\,t^3 \qquad \text{Equ. (433a)}$$

$$z_U=3\,(6)\,(1-t)^2\,t+3\,(9)\,(1-t)\,t^2+(5)\,t^3 \qquad \text{Equ. (124b)}$$

over the range of: $0 \leqq t \leqq 1$.

Thus, for this particular curve 133, the Bézier control points for the x-coordinates have been defined as: $Pxu_0=0$, $Pxu_1=0$, $Pxu_2=35$ and $Pxu_3=48$, and the Bézier control points for the z-coordinates have been defined as: $Pzu_0=0$, $Pzu_1=6$, $Pzu_2=9$ and $Pzu_3=5$.

As above, for this Example (4) club head, the Bézier equations (2a) and (2b) may be used to obtain, respectively, the x- and z-coordinates of the lower curve 134 of cross-section 130 as follows:

$$x_L=3\,(40)\,(1-t)\,t^2+(48)\,t^3 \qquad \text{Equ. (434a)}$$

$$z_L=3\,(-17)\,(1-t)^2\,t+3\,(-35)\,(1-t)\,t^2+(-37)\,t^3 \qquad \text{Equ. (434b)}$$

over the range of: $0 \leqq t \leqq 1$.

Thus, for this particular curve 134, the Bézier control points for the x-coordinates have been defined as: $PzL_0=0$, $PxL_1=0$, $PxL_2=40$ and $PxL_3=48$, and the Bézier control points for the z-coordinates have been defined as: $PzL_0=0$, $PzL_1=-17$, $PzL_2=-35$ and $PzL_3=-37$.

At cross-section 130 for Example (4), at 3 mm along the x-axis from the apex point 112, the lower curve 134 has a z-coordinate value that is 100% greater than the z-coordinate value of the upper curve 133. This introduces an initial asymmetry into the curves. From 3 mm to 24 mm along the x-axis, the upper curve 133 extends away from the x-axis by 3 mm (i.e., $\Delta z_U=7-4=3$ mm). The lower curve 134 extends away from the x-axis by an additional 18 mm (i.e., $\Delta z_L=26-8=18$ mm). And, from 3 mm to 36 mm along the x-axis, the upper curve 133 and the lower curve 134 extend away from the x-axis by an additional 3 mm and 24 mm, respectively. In other words, from 3 mm to 36 mm along the x-axis, the upper curve 133 is significantly flatter than the lower curve 134.

Further, for this Example (4) embodiment, when the curves of the cross-section 110 (i.e., the cross-section oriented at 90 degrees from the centerline) are compared to the curves of the cross-section 120 (i.e., the cross-section oriented at 70 degrees from the centerline), it can be seen that the upper curves vary significantly, while the lower curves are very similar. Specifically, the values of the z-coordinates for the upper curve 113 vary from the values of the z-coordinates for the upper curve 123 by up to 43% (relative to upper curve 123). Upper curve 123 is significantly flatter than upper curve 113. With respect to the lower curves 114 and 124 for the cross-sections 110 and 120, respectively, the values of the z-coordinates depart from each other by less than 10% over the x-coordinate range from 0 mm to 48 mm, with the lower curve 124 being slightly smaller than the lower curve 114.

When the curves for this Example (4) embodiment of the cross-section 110 (i.e., the cross-section oriented at 90 degrees from the centerline) are compared to the curves of the cross-section 130 (i.e., the cross-section oriented at 45 degrees from the centerline), it can be seen that the values of the z-coordinates for the lower curve 134 of the cross-section 130 differ from the values of the z-coordinates for the lower curve 114 of the cross-section 110 by over a range of 2 mm to 4 mm—over the x-coordinate range of 0 mm to 48 mm. Thus, for the Example (4) embodiment, the curvature of lower curve 134 varies somewhat from the curvature of lower curve 114. On the other hand, it can be seen that the difference in the values of the z-coordinates for the upper curve 133 of the cross-section 130 from the values of the z-coordinates for the upper curve 113 of the cross-section 110 steadily increases from a difference of 1 mm to a difference of 15 mm over the x-coordinate range of 0 mm to 48 mm. In other words, the curvature of the upper curve 133 significantly departs from curvature of the upper curve 113, with upper curve 133 being significantly flatter than upper curve 113.

It would be apparent to persons of ordinary skill in the art, given the benefit of this disclosure, that a streamlined region 100 similarly proportioned to the cross-sections 110, 120, 130 would achieve the same drag reduction benefits as the specific cross-sections 110, 120, 130 defined by Tables I-XII. Thus, the cross-sections 110, 120, 130 presented in Tables I-XII may be enlarged or reduced to accommodate club heads of various sizes. Additionally, it would be apparent to persons of ordinary skill in the art, given the benefit of this disclosure, that a streamlined region 100 having upper and lower curves that substantially accord with those defined by Tables I-XII would also generally achieve the same drag reduction benefits as the specific upper and lower curves presented in Tables I-XII. Thus, for example, the z-coordinate values may vary from those presented in Tables I-XII by up to ±5%, up to ±10%, or even in some instances, up to ±15%.

While there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, the golf club head may be any driver, wood, or the like. Further, it is expressly intended that all combinations of those elements which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface extending from the apex point, and a first sole-side surface extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the first crown-side surface is defined by the following spline points:

| | $x_1$-coordinate (mm) | | | | | |
|---|---|---|---|---|---|---|
| | 0 | 6 | 12 | 24 | 36 | 48 |
| $z_{1U}$-coordinate (mm) | 0 | 11 | 16 | 22 | 25 | 26 |

wherein the $z_{1U}$-coordinate may vary by ±10%.

2. The golf club head of claim 1, wherein the first sole-side surface is defined by the following spline points:

| | | | | | | |
|---|---|---|---|---|---|---|
| $x_1$-coordinate (mm) | 0 | 6 | 12 | 24 | 36 | 48 |
| $z_{1L}$-coordinate (mm) | 0 | −14 | −19 | −25 | −29 | −32 |

wherein the $z_{1L}$-coordinate may vary by ±10%.

3. A golf club head of claim 1, wherein the body member further has a second cross-section, wherein the second cross-section includes the apex point located on the leading edge, a second crown-side surface extending from the apex point, and a second sole-side surface extending from the apex point, wherein the second cross-section is oriented at approximately 70° from the centerline of the club head, wherein the apex point further represents an origin of a second $x_2$- and $z_2$-coordinate system oriented in the plane of the second cross-section at a roll angle of approximately 15°, and wherein the second crown-side surface is defined by the following spline points:

| | | | | | | |
|---|---|---|---|---|---|---|
| $x_2$-coordinate (mm) | 0 | 6 | 12 | 24 | 36 | 48 |
| $z_{2U}$-coordinate (mm) | 0 | 11 | 16 | 21 | 24 | 25 |

wherein the $z_{2U}$-coordinate may vary by ±10%.

4. The golf club head of claim 3, wherein the second sole-side surface is defined by the following spline points:

| | | | | | | |
|---|---|---|---|---|---|---|
| $x_2$-coordinate (mm) | 0 | 6 | 12 | 24 | 36 | 48 |
| $z_{2L}$-coordinate (mm) | 0 | −13 | −18 | −24 | −28 | −30 |

wherein the $z_{2L}$-coordinate may vary by ±10%.

5. A golf club head of claim 1, wherein the body member further has a second cross-section, wherein the second cross-section includes the apex point located on the leading edge, a second crown-side surface extending from the apex point, and a second sole-side surface extending from the apex point, wherein the second cross-section is oriented at approximately 45° from the centerline of the club head, wherein the apex point further represents an origin of a second $x_2$- and $z_2$-coordinate system oriented in the plane of the second cross-section at a roll angle of approximately 15°, and wherein the second crown-side surface is defined by the following spline points:

| | | | | | | |
|---|---|---|---|---|---|---|
| $x_2$-coordinate (mm) | 0 | 6 | 12 | 24 | 36 | 48 |
| $z_{2U}$-coordinate (mm) | 0 | 9 | 12 | 17 | 18 | 18 |

wherein the $z_{2U}$-coordinate may vary by ±10%, and wherein the second sole-side surface is defined by the following spline points:

| | | | | | | |
|---|---|---|---|---|---|---|
| $x_2$-coordinate (mm) | 0 | 6 | 12 | 24 | 36 | 48 |
| $z_{2L}$-coordinate (mm) | 0 | −12 | −16 | −22 | −26 | −29 |

wherein the $z_{2L}$-coordinate may vary by ±10%.

6. The golf club head of claim 1, wherein the body member is configured for attachment to a shaft having a longitudinal axis, and wherein the apex point is located approximately 15 mm to approximately 25 mm from the longitudinal axis of the shaft.

7. The golf club head of claim 1, wherein the body member is configured for attachment to a shaft having a longitudinal axis, and wherein the apex point is located approximately 20 mm from the longitudinal axis of the shaft.

8. The golf club head of claim 1, wherein the body member further includes a groove extending at least partially along a horizontal length of the toe and extending at least partially along a horizontal length of the back.

9. The golf club head of claim 1, wherein the club head has a volume of 420 cc or greater.

10. The golf club head of claim 1, wherein the club head has a face height of 53 mm or greater.

11. The golf club head of claim 1, wherein the club head has a club breadth-to-face length ratio of 0.92 or greater.

12. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface curve extending from the apex point, and a first sole-side surface curve extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the $x_1$- and $z_1$-coordinates of the first crown-side surface curve are defined by the following Bézier equations:

$$x_{1U}=3(17)(1-t)t^2+(48)t^3$$

$$z_{1U}=3(10)(1-t)^2t+3(26)(1-t)t^2+(26)t^3$$

over the range of: $0 \leqq t \leqq 1$, and wherein the value of $z_{1U}$ may vary by ±10%.

13. The golf club head of claim 12, wherein the $x_1$- and $z_1$-coordinates of the first sole-side surface curve are defined by the following Bézier equations:

$$x_{1L}=3(11)(1-t)t^2+(48)t^3$$

$$z_{1L}=3(-10)(1-t)^2t+3(-26)(1-t)t^2+(-32)t^3$$

over the range of: $0 \leqq t \leqq 1$, wherein the value of $z_{1L}$ may vary by ±10%.

14. The golf club head of claim 12, wherein the body member further has a second cross-section, wherein the second cross-section includes the apex point located on the leading edge, a second crown-side surface curve extending from the apex point, and a second sole-side surface curve extending from the apex point, wherein the second cross-section is oriented at approximately 70° from the centerline of the club head, wherein the apex point further represents an origin of a second $x_2$- and $z_2$-coordinate system oriented in the plane of the second cross-section at a roll angle of approximately 15°, and wherein the $x_{2U}$- and $z_{2U}$-coordinates of the second crown-side surface curve is defined by the following Bézier equations:

$$x_{2U}=3(19)(1-t)t^2+(48)t^3$$

$$z_{2U}=3(10)(1-t)^2t+3(25)(1-t)t^2+(25)t^3$$

over the range of: $0 \leqq t \leqq 1$, wherein the value of $z_{2U}$ may vary by ±10%.

15. The golf club head of claim 14, wherein the $x_{1L}$- and $z_{1L}$-coordinates of the second sole-side surface curve are defined by the following Bézier equations:

$$x_{2L}=3(13)(1-t)t^2+(48)t^3$$

$$z_{2L}=3(-10)(1-t)^2t+3(-26)(1-t)t^2+(-30)t^3$$

over the range of: $0 \leqq t \leqq 1$, wherein the value of $z_{2L}$ may vary by ±10%.

16. The golf club head of claim 12, wherein the body member is configured for attachment to a shaft having a longitudinal axis, and wherein the apex point is located approximately 15 mm to approximately 25 mm from the longitudinal axis of the shaft.

17. The golf club head of claim 12, wherein the body member is configured for attachment to a shaft having a longitudinal axis, and wherein the apex point is located approximately 20 mm from the longitudinal axis of the shaft.

18. The golf club head of claim 12, wherein the body member further includes a groove extending at least partially along a length of the toe and extending at least partially along a length of the back.

19. The golf club head of claim 12, wherein the volume of the club head is 420 cc or greater and the club breadth-to-face length ratio is 0.92 or greater.

20. A golf club head comprising:

a body member having a ball striking face, a crown, a toe, a heel, a sole, a back and a hosel region located at the intersection of the ball striking face, the heel, the crown and the sole, wherein the body member is configured for attachment to a shaft having a longitudinal axis, the body member including an apex point located in the heel approximately 10 mm to approximately 30 mm from the longitudinal axis of the shaft, the body member having a first cross-section oriented at approximately 90° from a centerline of the club head, the body member further having a second cross-section oriented at approximately 45° from the centerline of the club head, wherein the first and second cross-sections each include the apex point located in the heel and each having a respective crown-side surface curve extending from the apex point and a respective sole-side surface curve extending from the apex point, wherein the first cross-section has a first airfoil-shaped curvature in the heel and a first concave-shaped surface opposed to the heel, and wherein the second cross-section has a second airfoil-shaped curvature in the heel and a second concave-shaped surface opposed to the heel.

21. The golf club head of claim 20, wherein the apex point represents the origin of a first $x_1$- and $z_1$-coordinate system oriented in the plane of the first cross-section at a roll angle of approximately 15°, and wherein the first crown-side surface curve is defined by the following spline points:

| | | | | | | | | |
|---|---|---|---|---|---|---|---|---|
| $x_1$-coordinate (mm) | 0 | 3 | 6 | 12 | 18 | 24 | 36 | 48 |
| $z_{1U}$-coordinate (mm) | 0 | 7 | 11 | 16 | 19 | 22 | 25 | 26 |

wherein the value of the $z_{1U}$-coordinate may vary by ±10%.

22. The golf club head of claim 20, wherein the first sole-side surface curve is defined by the following spline points:

| | | | | | | | | |
|---|---|---|---|---|---|---|---|---|
| $x_1$-coordinate (mm) | 0 | 3 | 6 | 12 | 18 | 24 | 36 | 48 |
| $z_{1L}$-coordinate (mm) | 0 | −10 | −14 | −19 | −23 | −25 | −29 | −32 |

wherein value of the $z_{1L}$-coordinate may vary by ±10%.

23. The golf club head of claim 20, wherein the apex point further represents the origin of a second $x_2$- and $z_2$-coordinate system oriented in the plane of the second cross-section at a roll angle of approximately 15°, and wherein the second crown-side surface curve is defined by the following spline points:

| | | | | | | | | |
|---|---|---|---|---|---|---|---|---|
| $x_2$-coordinate (mm) | 0 | 3 | 6 | 12 | 18 | 24 | 36 | 48 |
| $z_{2U}$-coordinate (mm) | 0 | 7 | 11 | 16 | 19 | 21 | 24 | 25 |

wherein the value of the $z_{2U}$-coordinate may vary by ±10%.

24. The golf club head of claim 23, wherein the second sole-side surface curve is defined by the following spline points:

| | | | | | | | | |
|---|---|---|---|---|---|---|---|---|
| $x_2$-coordinate (mm) | 0 | 3 | 6 | 12 | 18 | 24 | 36 | 48 |
| $z_{2L}$-coordinate (mm) | 0 | −9 | −13 | −18 | −21 | −24 | −28 | −30 |

wherein the value of the $z_{2L}$-coordinate may vary by ±10%.

25. The golf club head of claim 20, wherein the apex point is located approximately 15 mm to approximately 25 mm from the longitudinal axis of the shaft.

26. The golf club head of claim 20, wherein the apex point is located approximately 20 mm from the longitudinal axis of the shaft.

27. The golf club head of claim 20, wherein the first and the second concave-shaped surfaces are formed by a continuous groove extending at least partially along a length of the toe and at least partially along a length of the back.

28. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface extending from the apex point, and a first sole-side surface extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the first crown-side surface is defined by the following spline points:

| | | | | | | |
|---|---|---|---|---|---|---|
| $x_1$-coordinate (mm) | 0 | 6 | 12 | 24 | 36 | 48 |
| $z_{1U}$-coordinate (mm) | 0 | 9 | 13 | 19 | 22 | 23 |

wherein the $z_{1U}$-coordinate may vary by ±10%, and wherein the first sole-side surface is defined by the following spline points:

| | | | | | | |
|---|---|---|---|---|---|---|
| $x_1$-coordinate (mm) | 0 | 6 | 12 | 24 | 36 | 48 |
| $z_{1L}$-coordinate (mm) | 0 | −13 | −18 | −24 | −30 | −33 |

wherein the $z_{1L}$-coordinate may vary by ±10%.

29. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface curve extending from the apex point, and a first sole-side surface curve extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the $x_1$- and $z_1$-coordinates of the first crown-side surface curve are defined by the following Bézier equations:

$$x_{1U}=3(22)(1-t)t^2+(48)t^3$$

$$z_{1U}=3(8)(1-t)^2t+3(23)(1-t)t^2+(23)t^3$$

over the range of: $0 \leqq t \leqq 1$, and wherein the value of $z_{1U}$ may vary by ±10%, and wherein the $x_1$- and $z_1$-coordinates of the first sole-side surface curve are defined by the following Bézier equations:

$$x_{1L}=3(18)(1-t)t^2+(48)t^3$$

$$z_{1U}=3(-12)(1-t)^2t+3(-25)(1-t)t^2+(-33)t^3$$

over the range of: $0 \leqq t \leqq 1$, wherein the value of $z_{1L}$ may vary by ±10%.

30. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface extending from the apex point, and a first sole-side surface extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the first crown-side surface is defined by the following spline points:

| | | | | | | |
|---|---|---|---|---|---|---|
| $x_1$-coordinate (mm) | 0 | 6 | 12 | 24 | 36 | 48 |
| $z_{1U}$-coordinate (mm) | 0 | 6 | 7 | 10 | 11 | 11 |

wherein the $z_{1U}$-coordinate may vary by ±10%, and wherein the first sole-side surface is defined by the following spline points:

| | | | | | | |
|---|---|---|---|---|---|---|
| $x_1$-coordinate (mm) | 0 | 6 | 12 | 24 | 36 | 48 |
| $z_{1L}$-coordinate (mm) | 0 | −20 | −26 | −34 | −40 | −44 |

wherein the $z_{1L}$-coordinate may vary by ±10%.

31. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface curve extending from the apex point, and a first sole-side surface curve extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the $x_1$- and $z_1$-coordinates of the first crown-side surface curve are defined by the following Bézier equations:

$$x_{1U}=3(17)(1-t)t^2+(48)t^3$$

$$z_{1U}=3(5)(1-t)^2t+3(12)(1-t)t^2+(11)t^3$$

over the range of: $0 \leqq t \leqq 1$, and wherein the value of $z_{1U}$ may vary by ±10%, and wherein the $x_1$- and $z_1$-coordinates of the first sole-side surface curve are defined by the following Bézier equations:

$$x_{1L}=3(7)(1-t)t^2+(48)t^3$$

$$z_{1L}=3(-15)(1-t)^2t+3(-32)(1-t)t^2+(-44)t^3$$

over the range of: $0 \leqq t \leqq 1$, wherein the value of $z_{1L}$ may vary by ±10%.

32. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface extending from the apex point, and a first sole-side surface extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the first crown-side surface is defined by the following spline points:

| $x_1$-coordinate (mm) | 0 | 6 | 12 | 24 | 36 | 48 |
|---|---|---|---|---|---|---|
| $z_{1U}$-coordinate (mm) | 0 | 7 | 11 | 16 | 19 | 20 |

wherein the $z_{1U}$-coordinate may vary by ±10%, and wherein the first sole-side surface is defined by the following spline points:

| $x_1$-coordinate (mm) | 0 | 6 | 12 | 24 | 36 | 48 |
|---|---|---|---|---|---|---|
| $z_{1L}$-coordinate (mm) | 0 | −14 | −21 | −30 | −36 | −40 |

wherein the $z_{1L}$-coordinate may vary by ±10%.

33. A golf club head for a driver, the golf club head having a volume of 400 cc or greater and a club breadth-to-face length ratio of 0.90 or greater, the golf club head comprising:

a body member having a crown, a sole, and a heel, and further including a leading edge in the heel, the leading edge defined as the surface of the heel having a vertical slope when the club head is in a 60 degree lie angle position, the body member further having a first cross-section, wherein the first cross-section includes an apex point located on the leading edge, a first crown-side surface curve extending from the apex point, and a first sole-side surface curve extending from the apex point, wherein the first cross-section is oriented perpendicular to a centerline of the club head, wherein the apex point represents an origin of a first $x_1$- and $z_1$-coordinate system oriented in the plane of the first cross-section at a roll angle of approximately 15°, and wherein the $x_1$- and $z_1$-coordinates of the first crown-side surface curve are defined by the following Bézier equations:

$$x_{1U}=3(31)(1-t)t^2+(48)t^3$$

$$z_{1U}=3(9)(1-t)^2t+3(21)(1-t)t^2+(20)t^3$$

over the range of: $0 \leqq t \leqq 1$, and wherein the value of $z_{1U}$ may vary by ±10%, and wherein the $x_1$- and $z_1$-coordinates of the first sole-side surface curve are defined by the following Bézier equations:

$$x_{1L}=3(30)(1-t)t^2+(48)t^3$$

$$z_{1L}=3(-17)(1-t)^2t+3(-37)(1-t)t^2+(-40)t^3$$

over the range of: $0 \leqq t \leqq 1$, wherein the value of $z_{1L}$ may vary by ±10%.

34. A golf club comprising:

a shaft; and the golf club head according to one of the claims 1, 12, 20, 28, 29, 30, 31, 32 and 33, wherein the golf club head is secured to a first end of the shaft.

* * * * *